US012569033B2

(12) United States Patent
Baghdadi et al.

(10) Patent No.: US 12,569,033 B2
(45) Date of Patent: Mar. 10, 2026

(54) CUSHIONING STRUCTURE FOR ARTICLE OF FOOTWEAR

(71) Applicant: NIKE, Inc., Beaverton, OR (US)

(72) Inventors: Hossein A. Baghdadi, Portland, OR (US); Jeremy L. Connell, Portland, OR (US); Jay Constantinou, Beaverton, OR (US); Sami M. Fakhouri, Portland, OR (US); Joseph Thomas Muth, Boxford, MA (US); Bradley C. Tutmark, Alhoa, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/407,966

(22) Filed: Jan. 9, 2024

(65) Prior Publication Data

US 2024/0225182 A1 Jul. 11, 2024

Related U.S. Application Data

(60) Provisional application No. 63/479,369, filed on Jan. 11, 2023.

(51) Int. Cl.
*A43B 13/22* (2006.01)
*A43B 13/02* (2022.01)

(52) U.S. Cl.
CPC ..... *A43B 13/226* (2013.01); *A43B 13/023* (2013.01)

(58) Field of Classification Search
CPC ..... A43B 13/023; A43B 13/026; A43B 13/04; A43B 13/181; A43B 13/186–188; A43B 13/226
See application file for complete search history.

(56) References Cited

U.S. PATENT DOCUMENTS 4,219,945 A * 9/1980 Rudy ..... A43B 13/203 36/44
4,391,048 A 7/1983 Lutz
4,535,553 A * 8/1985 Derderian ..... A43B 13/181 36/28
5,083,361 A * 1/1992 Rudy ..... B32B 7/02 29/454

(Continued)

FOREIGN PATENT DOCUMENTS

WO WO-2016205122 A1 12/2016
WO WO-2021201826 A1 10/2021

OTHER PUBLICATIONS

European Patent Office (ISA), International Search Report and Written Opinion for PCT App. No. PCT/US2024/011042, mailed Apr. 16, 2024.

(Continued)

*Primary Examiner* — Bao-Thieu L Nguyen
(74) *Attorney, Agent, or Firm* — Honigman LLP; Matthew H. Szalach; Jonathan P. O'Brien

(57) ABSTRACT

A sole structure includes a first support extending along a first axis transverse to a ground-engaging surface of the sole structure and having a first outer sheath including a first sheath material and a first core including a first core material. The sole structure further includes a second support extending along a second axis transverse to the ground-engaging surface of the sole structure and having a second outer sheath including a second sheath material and a second core including a second core material.

11 Claims, 14 Drawing Sheets

(56) References Cited

U.S. PATENT DOCUMENTS

| | | | | |
|---|---|---|---|---|
| 5,713,140 | A * | 2/1998 | Baggenstoss | A43B 13/206 36/28 |
| 5,946,824 | A * | 9/1999 | Tighe | A43B 13/181 36/28 |
| 6,029,962 | A * | 2/2000 | Shorten | B29C 66/1312 267/145 |
| 6,763,611 | B1 * | 7/2004 | Fusco | A43B 13/181 36/27 |
| 9,474,313 | B2 * | 10/2016 | Kamradt | F16F 3/093 |
| 11,805,843 | B2 | 11/2023 | Gross | |
| 2003/0121177 | A1 * | 7/2003 | Lee | A43B 7/12 36/14 |
| 2005/0126038 | A1 * | 6/2005 | Skaja | A43B 23/024 36/25 R |
| 2006/0130365 | A1 * | 6/2006 | Sokolowski | A43B 3/0042 36/35 R |
| 2007/0277396 | A1 * | 12/2007 | Swigart | A43B 21/26 36/27 |
| 2009/0117301 | A1 | 5/2009 | Lin | |
| 2016/0157553 | A1 * | 6/2016 | Cross | A43B 13/023 36/30 R |
| 2016/0324260 | A1 * | 11/2016 | Guyan | A43B 13/04 |
| 2018/0271213 | A1 * | 9/2018 | Perrault | A43B 13/141 |
| 2018/0368518 | A1 * | 12/2018 | Re | A43B 13/181 |
| 2020/0068990 | A1 * | 3/2020 | Taniguchi | A43B 13/026 |
| 2021/0078276 | A1 | 3/2021 | Baghdadi et al. | |
| 2021/0186151 | A1 * | 6/2021 | Gross | A43B 13/04 |
| 2022/0002943 | A1 * | 1/2022 | Sloan | D07B 1/162 |
| 2022/0110407 | A1 * | 4/2022 | Hettinga | A43B 3/46 |
| 2022/0408880 | A1 * | 12/2022 | Iwasa | A43B 13/125 |
| 2023/0225452 | A1 * | 7/2023 | Sakamoto | A43B 13/125 36/25 R |
| 2023/0255308 | A1 * | 8/2023 | Bidal | A43B 13/12 36/127 |
| 2024/0225178 | A1 * | 7/2024 | Baghdadi | A43B 13/186 |
| 2024/0245165 | A1 * | 7/2024 | Chen | A43D 999/00 |

OTHER PUBLICATIONS

European Patent Office (ISA), International Search Report and Written Opinion for PCT App. No. PCT/US2024/011054, mailed Apr. 23, 2024.

Ou, Haihua et al., "Boosting Energy Return Using 3D Printed Midsoles Designed With Compliant Constant Force Mechanisms," ASME Journal of Mechanical Design, Jun. 2024, vol. 146, pp. 062001-1-062001-8.

* cited by examiner

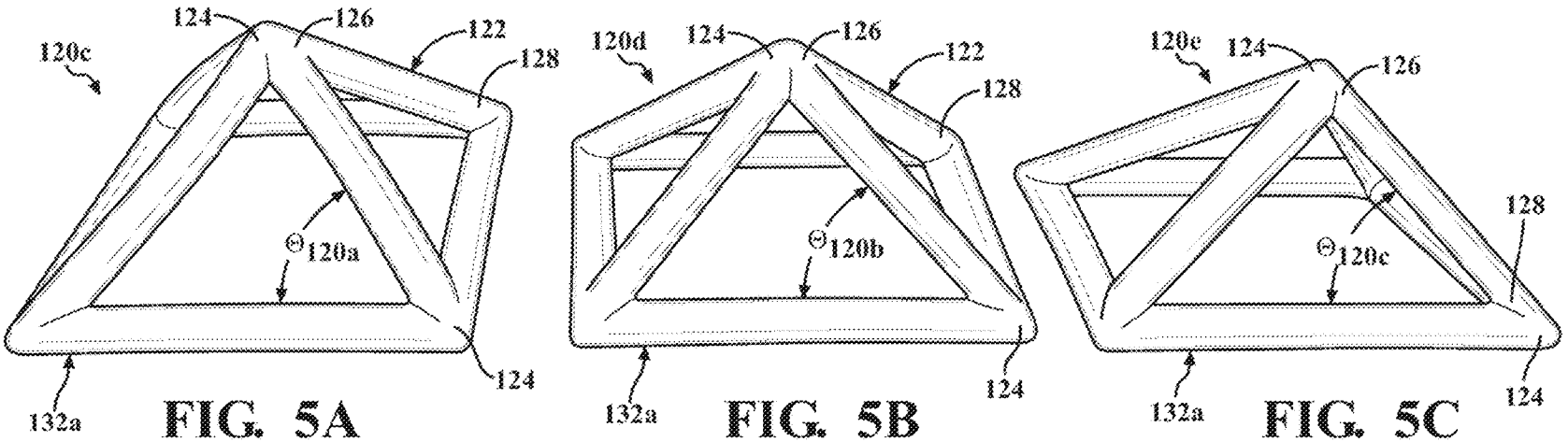
FIG. 5A
FIG. 5B
FIG. 5C
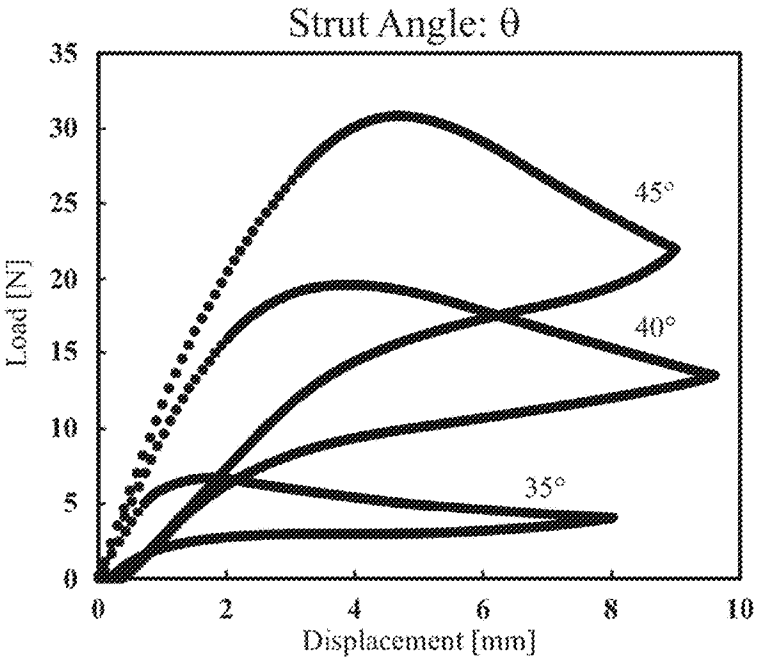
FIG. 5D

CUSHIONING STRUCTURE FOR ARTICLE OF FOOTWEAR

CROSS REFERENCE TO RELATED APPLICATIONS

This application claims priority under 35 U.S.C. § 119(e) to U.S. Provisional Application No. 63/479,369, filed on Jan. 11, 2023. The disclosure of this prior application is considered part of the disclosure of this application and is hereby incorporated by reference in its entirety.

FIELD

The present disclosure relates generally to a cushioning structure for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. For example, a sole structure may include a midsole and an outsole. The midsole is generally disposed between the outsole and the upper and provides cushioning for the foot. The midsole may include a pressurized fluid-filled chamber that compresses resiliently under an applied load to cushion the foot by attenuating ground-reaction forces. The outsole provides abrasion-resistance and traction with the ground surface and may be formed from rubber or other materials that impart durability and wear-resistance, as well as enhance traction with the ground surface.

While sole structures have proven acceptable for their intended purposes, a continuous need for improvement in the relevant art remains. For example, a need exists for a sole structure that provides an improved underfoot feel. A need also exists for an article of footwear having improved overall comfort and fit while providing such improved performance.

BRIEF DESCRIPTION OF DRAWINGS

The drawings described herein are for illustrative purposes only of selected configurations and not all possible implementations, and are not intended to limit the scope of the present disclosure.

FIGS. 5A-5C show examples of truss structures having different strut angles according to the principles of the present disclosure.

FIG. 5D shows a graph illustrating the measured effect of strut angle on the relationship between displacement and load for the example truss structures of FIGS. 5A-5C.

Corresponding reference numerals indicate corresponding parts throughout the drawings.

DETAILED DESCRIPTION

Figure 1:
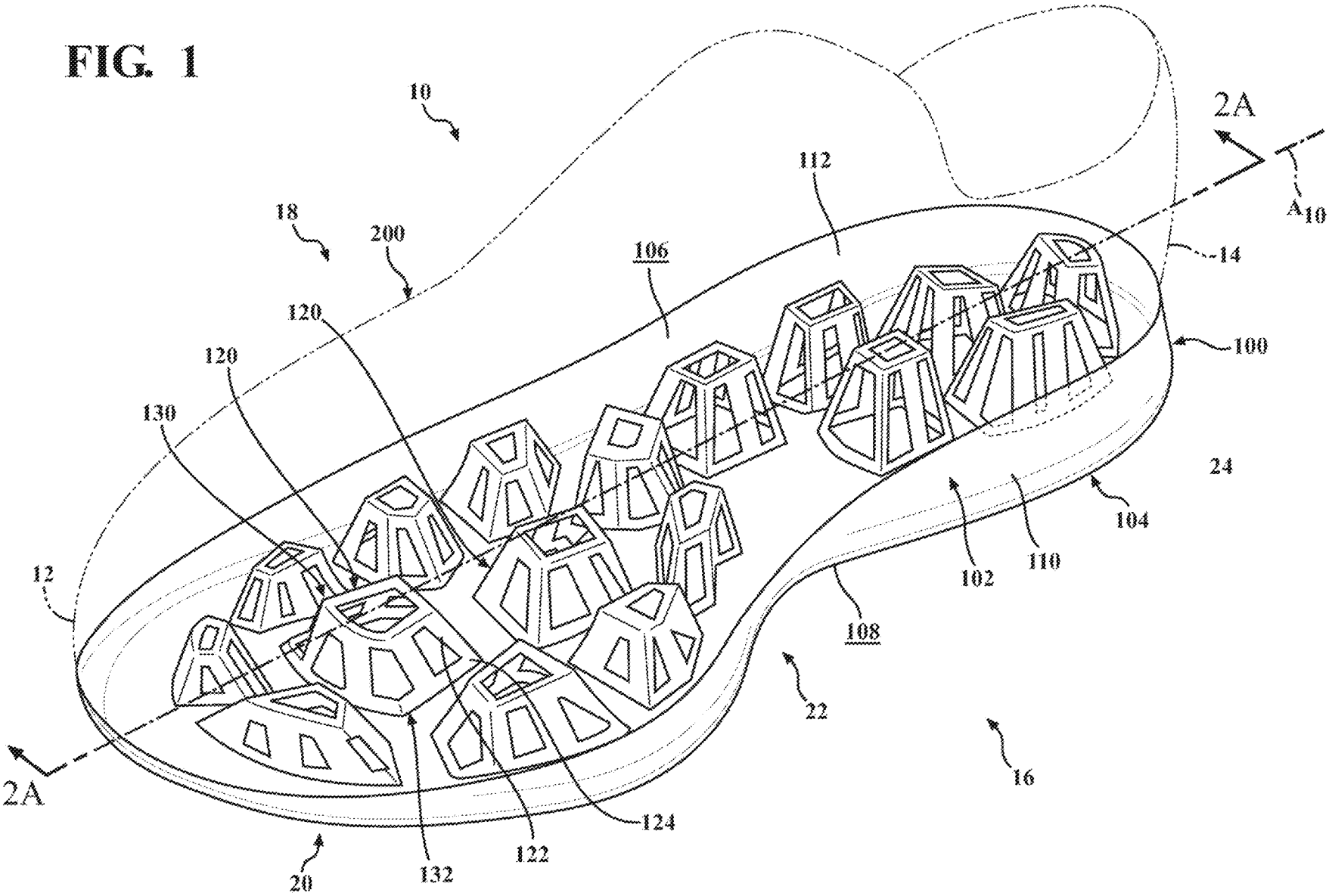
FIG. 1 shows an article of footwear incorporating an example of a sole structure according to the principles of the present disclosure.

Conventional cushioning elements for articles of footwear often rely on material properties of one or more compressible materials, such as fluids and polymers. For instance, known sole structures may include solid bodies of compressible foam materials to provide cushioning characteristics along the sole structure. Other examples may rely on compressible fluids, such as air or nitrogen, to provide cushioning characteristics. While suitable, the use of conventional compressible structures (e.g., foam, bladders) results in a direct relationship between displacement (e.g., compression) of the compressible material and load applied to the compressible material. In other words, increased displacement results in increased load. Furthermore, the stiffness of these materials also increases with displacement, causing the increases in load to become larger and larger. This relationship results in an underfoot feel in which increased loads associated with actions such as running or jumping (as opposed to lower loads associated with walking) may result in a stiffer underfoot feel as the cushioning material (e.g., air, foam) is compressed to a greater extent.

In the present disclosure, designs for cushioning structures have been identified that provide an improved underfoot feel during a gait cycle. The cushioning structures include various examples of truss structures each having a plurality of struts configured to extend between an upper support surface of a sole structure and a ground-engaging surface. When a load is applied to the upper support surface of the sole structure, the load is transferred along a longitudinal axis of each of the struts. The struts may be oriented at oblique angles relative to the support surface and the applied load such that a load applied as a purely compressive load to the support surface is converted into a compressive load and a bending load distributed along the strut. As the applied load increases, the resulting bending load applied to each strut causes the strut to bend or deflect along its length. Increased bending along each strut induces a corresponding reduction in the compressive force required to displace or deflect the strut. In other words, as the strut bends more, the strut bends easier. By utilizing this structural cushioning design, a sole structure may be configured to allow for a greater degree of deflection (compression) without requiring continuously increased loading, continuously increased stiffness, or both. Thus, the use of structural cushioning according to the present disclosure allows for comparable or superior energy storage within a sole structure during a gait cycle as conventional solid compressible materials, while providing an improved underfoot feel by allowing increased displacement with minimal increases to loading. Additionally, the use of cushioning structures according to the present disclosure allows for a highly tunable cushioning solution, whereby cushioning parameters can be selected by modifying any combination of strut thickness, strut angle, strut twist, material type, etc.

Additionally, material structures have been found that provide desirable cushioning properties across a wide range of displacements. For example, forming the structural cushioning components with an inner core having a first material first density and an outer sheath having a second density that is greater than the first density provides the structural cushioning elements with a composite structure, whereby the outer shell provides the strut with structural integrity while the lower density of the inner core minimizes overall weight. For example, the structural cushioning elements may be foamed using a physical foaming process producing microcellular foam (e.g., the MUCELL foaming process by Trexel, Inc., headquartered in Boston, Massachusetts, United States of America) to form the inner core and the outer sheath.

An aspect of the disclosure provides a sole structure for an article of footwear. The sole structure includes a first support extending along a first axis transverse to a ground-engaging surface of the sole structure and having an outer sheath and a core. The outer sheath of the first support comprises a first sheath material, and the core of the first support comprises a first core material.

Aspects of the disclosure may include one or more of the following optional features. In some implementations, the first sheath material has a higher density than the first core material. In some examples, the density of the first sheath material and the first core material are substantially the same. In some configurations, the first sheath material is a polymeric material including a first sheath polymeric component consisting of all polymers present in the first sheath material, and the first core material is a polymeric material including a first core polymeric component consisting of all polymers present in the first core material, optionally wherein the first sheath polymeric component and the first core polymeric component are the same.

In some implementations, the first sheath material and the first core material may be thermoplastic materials. In some examples, the first core material is a polymeric foam, optionally a physically-foamed polymeric foam or a chemically-foamed polymeric foam. In some examples, the first support is an injection-molded support. In some configurations, the first core material is an injection molded polymeric foam. In some implementations, the first sheath material and the first core material are the same injection molded polymeric material, the outer sheath is an external skin formed in contact with a mold surface in an injection molding process, and the first sheath material is unfoamed or is a foam having a higher density than the injection molded polymeric foam of the first core material.

In some configurations, the first sheath material is a thermoplastic material, optionally a thermoplastic elastomeric material. In some implementations, the first sheath material comprises a polymer chosen from a polyurethane, a polyester, a polyamide, a polystyrene, a polyolefin, and any combination thereof. In some examples, the first sheath material comprises a thermoplastic elastomeric polyurethane, optionally a thermoplastic elastomeric polyester-polyurethane. In some implementations, the first sheath material comprises a thermoplastic elastomeric polyester copolymer, optionally a thermoplastic elastomeric polyetherester copolymer. In some examples, the first sheath material comprises a thermoplastic elastomeric polyamide copolymer, optionally a thermoplastic elastomeric polyamide block copolymer. In some configurations, the first sheath material comprises a thermoplastic elastomeric polystyrene copolymer, optionally a thermoplastic elastomeric styrene-ethylene-butadiene-styrene (SEBS) copolymer. In some implementations, the first sheath material comprises a thermoplastic elastomeric polyolefin homopolymer or copolymer, optionally a thermoplastic elastomeric ethylene-propylene copolymer or a thermoplastic elastomeric ethylene-vinyl acetate (EVA) copolymer.

In some examples, the first core material is a thermoplastic material, optionally a thermoplastic elastomeric material. In some implementations, the first core material comprises a polymer chosen from a polyurethane, a polyester, a polyamide, a polystyrene, a polyolefin, and any combination thereof. In some configurations, the first core material comprises a thermoplastic elastomeric polyurethane, optionally a thermoplastic elastomeric polyester-polyurethane. In some examples, the first core material comprises a thermoplastic elastomeric polyester copolymer, optionally a thermoplastic elastomeric polyetherester copolymer. In some examples, the first core material comprises a thermoplastic elastomeric polyamide copolymer, optionally a thermoplastic elastomeric polyamide block copolymer. In some implementations, the first core material comprises a thermoplastic elastomeric polystyrene copolymer, optionally a thermoplastic elastomeric styrene-ethylene-butadiene-styrene (SEBS) copolymer. In some configurations, the first core material comprises a thermoplastic elastomeric polyolefin homopolymer or copolymer, optionally a thermoplastic elastomeric ethylene-propylene copolymer or a thermoplastic elastomeric ethylene-vinyl acetate (EVA) copolymer. In some configurations, the outer sheath completely surrounds the core.

In some examples, the sole structure includes a second support extending along a second axis transverse to the ground-engaging surface of the sole structure and having a second outer sheath and a second core, wherein the second outer sheath of the second support comprises a second sheath material, and the second core of the second support comprises a second core material. In some implementations, the second outer sheath of the second support has a higher density than the second core of the second support. In some configurations, the second axis is convergent with the first axis. In some examples, a first distal end of the first support is connected to a second distal end of the second support. In some implementations, at least one of the first support and the second support are elongate. In some configurations, the first support is elongate.

In some examples, the sole structure includes a filler material disposed on at least the first outer sheath of the first support. In some configurations, the filler material is a polymeric material, optionally a thermoplastic material, optionally a thermoplastic elastomeric material. In some implementations, the filler material comprises a polymer chosen from a polyurethane, a polyester, a polyamide, a polystyrene, a polyolefin, and any combination thereof. In some examples, the filler material comprises a thermoplastic elastomeric polyurethane, optionally a thermoplastic elastomeric polyester-polyurethane. In some configurations, the filler material comprises a thermoplastic elastomeric polyester copolymer, optionally a thermoplastic elastomeric polyetherester copolymer. In some examples, the filler material comprises a thermoplastic elastomeric polyamide copolymer, optionally a thermoplastic elastomeric polyamide block copolymer. In some implementations, the filler material comprises a thermoplastic elastomeric polystyrene copolymer, optionally a thermoplastic elastomeric styrene-ethylene-butadiene-styrene (SEBS) copolymer. In some configurations filler material comprises a thermoplastic elastomeric polyolefin homopolymer or copolymer, optionally a thermoplastic elastomeric ethylene-propylene copolymer or a thermoplastic elastomeric ethylene-vinyl acetate (EVA) copolymer.

In some examples, the sole structure includes a second support extending along a second axis transverse to the ground-engaging surface of the sole structure and having a second outer sheath and a second core, and wherein the filler material is disposed between the first support and the second support.

In some examples, the sole structure includes a third support extending along a third axis transverse to the ground-engaging surface of the sole structure and having a third outer sheath and a second core, and wherein the filler material is disposed between the second support and the third support. In some implementations, the filler material is disposed between the first support and the third support. In some configurations, the filler material defines a cushioning component including an upper support surface of the sole structure. In some implementations, the cushioning component defines the ground-engaging surface of the sole structure formed on an opposite side from the support surface.

In some examples, the sole structure includes an outsole attached to the first support at the ground-engaging surface. Some examples include an article of footwear incorporating the sole structure of any of the preceding paragraphs.

Another aspect of the disclosure provides a sole structure for an article of footwear. The sole structure includes a first support extending along a first axis transverse to a ground-engaging surface of the sole structure and having a first outer sheath including a first sheath material and a first core including a first core material. The sole structure further includes a second support extending along a second axis transverse to the ground-engaging surface of the sole structure and having a second outer sheath including a second sheath material and a second core including a second core material.

Aspects of the disclosure may include one or more of the following features. In some examples, the first core is a first foam core, and first sheath material has a higher density than the first core material. In some configurations, the second core is a second foam core, and second sheath material has a higher density than the second core material. In some examples, a density of the first sheath material and the first core material are substantially the same. In some implementations, a density of the second sheath material and the second core material are substantially the same.

In some examples, the first sheath material is a polymeric material including a first sheath polymeric component consisting of all polymers present in the first sheath material, and the first core material is a polymeric material including a first core polymeric component consisting of all polymers present in the first core material, optionally wherein the first sheath polymeric component and the first core polymeric component are the same. In some examples, the second sheath material is a polymeric material including a second sheath polymeric component consisting of all polymers present in the second sheath material, and the second core material is a polymeric material including a second core polymeric component consisting of all polymers present in the second core material, optionally wherein the second sheath polymeric component and the second core polymeric component are the same.

In some implementations, the first outer sheath completely surrounds the first core and the second outer sheath completely surrounds the second core. In some configurations, the first outer sheath has a higher density than the first core and the second outer sheath has a higher rigidity than the second core.

In some examples, the first axis and the second axis are convergent. In some implementations, the first support and the second support intersect one another. In some configurations, a first distal end of the first support is connected to a second distal end of the second support. In some examples, at least one of the first support and the second support are elongate.

In some implementations, the sole structure includes a third support extending along a third axis transverse to the ground-engaging surface of the sole structure and having a third outer sheath and a third foam core, the third support attached to the first support and the second support to form a pyramid.

In some examples, the first outer sheath and the first core comprise the same material and the second outer sheath and the second core comprise the same material. In some implementations, the first outer sheath completely surrounds the first core and the second outer sheath completely surrounds the second core. In some configurations, the first outer sheath has a higher density than the first core and the second outer sheath has a higher density than the second core.

In some configurations, the first axis and the second axis are convergent. In some examples, the first support and the second support intersect one another. In some implementations, a first distal end of the first support is connected to a second distal end of the second support. In some implementations, at least one of the first support and the second support are elongate. In some examples, the sole structure is incorporated into an article of footwear.

Another aspect of the disclosure provides an article of footwear. The article of footwear includes a first support extending along a first axis from a first upper distal end at a support surface of the sole structure to a first lower distal end at a ground-engaging surface of the sole structure. The article of footwear also includes a second support extending along a second axis from a second upper distal end at the support surface of the sole structure to a second lower distal end at the ground-engaging surface of the sole structure.

Aspects of the disclosure may include one or more of the following optional features. In some examples, the first upper distal end of the first support is connected to the second upper distal end of the second support. In some implementations, the first upper distal end of the first support and the second upper distal end of the second support are both connected to a first node disposed at the support surface of the sole structure. In some examples, the first lower distal end of the first support is connected to the second lower distal end of the second support at the ground-engaging surface of the sole structure.

In some configurations, the first support has a first thickness measured across the first axis and the second support has a second thickness measured across the second axis. In some examples, the first thickness is the same as the second thickness. In some configurations, the first thickness is different from the second thickness, optionally wherein the first thickness differs from the second thickness by 5 percent or more. In some implementations, the first axis of the first support extends at an oblique angle relative to at least one of the ground-engaging surface or the support surface.

In some examples, the sole structure includes a bladder defining a chamber, wherein the first support and the second support are disposed within the chamber. Optionally, the bladder includes (i) an upper barrier layer attached to the first upper distal end of the first support and the second upper distal end of the second support and (ii) a lower barrier layer attached to the first lower distal end of the first support and the second lower distal end of the second support.

In some implementations, the first support includes a first outer sheath comprising a first sheath material and a first inner core comprising a first core material, and wherein the second support includes a second outer sheath comprising a second sheath material and a second inner core comprising a second core material. In some configurations, the first core material is a first foam material, and first sheath material has a higher density than the first core material. In some examples, the second core is a second foam core, and second sheath material has a higher density than the second core material. In some examples, a density of the first sheath material and the first core material are substantially the same. In some implementations, a density of the second sheath material and the second core material are substantially the same.

In some configurations, the first sheath material is a polymeric material including a first sheath polymeric component consisting of all polymers present in the first sheath material, and the first core material is a polymeric material including a first core polymeric component consisting of all polymers present in the first core material, optionally wherein the first sheath polymeric component and the first core polymeric component are the same. In some implementations, the second sheath material is a polymeric material including a second sheath polymeric component consisting of all polymers present in the second sheath material, and the second core material is a polymeric material including a second core polymeric component consisting of all polymers present in the second core material, optionally wherein the second sheath polymeric component and the second core polymeric component are the same.

In some examples, the sole structure includes a foam cushioning element adjacent to each of the first upper distal end and the second upper distal end and defining the support surface of the sole structure, wherein the foam cushioning element comprises a foam cushioning element material, the foam cushioning element material comprising a polymeric component consisting of all the polymers present in the foam cushioning element material, optionally wherein the polymeric component of the foam cushioning element material is different from the first sheath polymeric component of the first sheath material, or is different from the second sheath polymeric component of the second sheath material, or is different from both the first sheath material and the second sheath material.

Another aspect of the disclosure provides a method of forming a sole structure. The method includes extending a first support along a first axis transverse to a ground-engaging surface of the sole structure and having an outer sheath including a first sheath material and a foam core including a first core material, the outer sheath having a higher density than the foam core.

Aspects of the method may include one or more of the following features. In some examples, the method includes forming the outer sheath and the foam core from the same material. In some examples, the method includes completely surrounding the foam core with the outer sheath. In some implementations, the method includes extending a second support along a second axis transverse to the ground-engaging surface of the sole structure and having an outer sheath and a foam core. In some configurations, the method includes providing the second support with an outer sheath having a higher rigidity than the foam core of the second support. In some configurations, the method includes extending the second support along a second axis includes extending the second support along a second axis that is convergent with the first axis.

In some implementations, the method includes connecting a first distal end of the first support to a second distal end of the second support. In some examples, the method includes providing the first support with a length that is greater than its width and providing the second support with a length that is greater than its width. In some implementations, the method includes providing the first support with a length that is greater than its width.

In some configurations, the first sheath material and the first core material are both polymeric materials, and the method further comprises injection molding the first sheath polymeric material and the first core polymeric material to form the first support. In some examples, the injection molding process includes foaming the first core polymeric material, optionally wherein the foaming comprises physically-foaming the first core polymeric material or chemically-foaming the first core polymeric material. In some configurations, the foaming comprises physically-foaming the first core polymeric material using a physical foaming agent, and the physical foaming agent comprises or consists essentially of a supercritical fluid chosen from supercritical carbon dioxide ($CO_2$) and supercritical nitrogen ($N_2$).

In some aspects of the method, the first sheath material and the first core material are the same polymeric material. Here, the injection molding process includes melting the polymeric material to form molten polymeric material, mixing the molten polymeric material and a supercritical fluid to form a single-phase solution of the supercritical fluid dissolved in the molten polymeric material, injecting the single-phase solution into a mold cavity configured to form the first support, decreasing pressure within the mold cavity to initiate formation and expansion of gas bubbles within the molten polymeric material as the supercritical fluid phase transitions to a gas, thereby physically foaming the polymeric material, and solidifying the physically-foamed polymeric material in the mold cavity, thereby forming the first support, wherein, following the solidification, the first outer sheath comprises the polymeric material in the form of a solidified skin surrounding the foam core, and the foam core comprises solidified physically-foamed polymeric material;

optionally, wherein the method further comprises removing the first support from the mold cavity.

In some implementations, the solidified skin and the solidified physically-foamed polymeric material are thermoplastic. In some examples, the method further includes disposing a filler material onto the first outer sheath, optionally wherein the filler material is a polymeric filler material. In some examples, disposing includes injecting a filler material onto the outer sheath. In some implementations, the disposing further includes foaming the disposed filler material, wherein the foaming comprises physically foaming the disposed filler material or chemically foaming the disposed filler material.

In some examples, the disposing includes injecting a single-phase solution of a molten filler polymeric material and a supercritical fluid physical foaming agent onto the first outer sheath of the first support while within a mold cavity configured to form a composite structure including the first support, decreasing a pressure within the mold cavity, decreasing pressure within the mold cavity to initiate formation and expansion of gas bubbles within the molten filler polymeric material as the supercritical fluid phase transitions to a gas, thereby physically foaming the filler polymeric material, solidifying the foamed filler polymeric material in the mold cavity, thereby forming the composite structure including the first support, wherein, following the solidification, the composite structure includes the first support surrounded by the solidified physically-foamed filler polymeric material, and removing the solidified composite structure from the mold cavity.

Another aspect of the disclosure provides a method of forming an article of footwear. The method includes incorporating the sole structure of any of the preceding paragraphs into the article of footwear.

Another aspect of the disclosure provides a method of forming a sole structure for an article of footwear. The method includes extending a first support along a first axis transverse to a ground-engaging surface of the sole structure and having a first outer sheath and a first core. The method also includes extending a second support along a second axis transverse to the ground-engaging surface of the sole structure and having a second outer sheath and a second core.

Aspects of the disclosure may include one or more of the following optional features. In some examples, the first core is a first foam core, or the second core is a second foam core, or both the first core is a first foam core and the second core is a second foam core. In some implementations, the method includes forming the first outer sheath and the first foam core from the same material and forming the second outer sheath and the second foam core from the same material. In some examples, the method includes completely surrounding the first foam core with the first outer sheath and completely surrounding the second foam core with the second outer sheath. In some implementations, the method includes providing the first outer sheath with a higher density than the first foam core and providing the second outer sheath with a higher density than the second foam core.

In some implementations, extending the second support along a second axis includes extending the second support along a second axis that is convergent with the first axis. In some examples, the method includes intersecting the first support and the second support. In some examples, the method includes connecting a first distal end of the first support to a second distal end of the second support at a joint. In some examples, the method includes providing the first support with a length that is greater than its width and providing the second support with a length that is greater than its width. In some implementations, the method includes extending a third support along a third axis transverse to the ground-engaging surface of the sole structure and having a third outer sheath and a third foam core, the third support attached to the first support and the second support to form a pyramid.

In some examples, the method includes forming at least one of the first support and the second support via a physical foaming process, optionally via a MUCELL physical foaming process. In some implementations, the method includes incorporating the sole structure into an article of footwear.

Another aspect of the disclosure provides a sole structure for an article of footwear. The sole structure includes a first support extending along a first axis transverse to a ground-engaging surface of the sole structure, the first support being formed via a physical foaming process, optionally via a MUCELL physical foaming process.

Aspects of the disclosure may include one or more of the following optional features. In some examples, the first support includes a first core and a first outer sheath formed by the MUCELL physical foaming process. In some implementations, the first outer sheath and the first core are formed from the same material. In some examples, first outer sheath has a higher density than the first core. In some implementations, the sole structure includes a second support extending along a second axis transverse to a ground-engaging surface of the sole structure, the second support being formed via the physical foaming process, optionally via the MUCELL physical foaming process. In some configurations, the second support includes a second core and a second outer sheath formed by the MUCELL physical foaming process. In some implementations, the second outer sheath and the second core are formed from the same material.

In some examples, the second outer sheath has a higher density than the second core. In some implementations, the sole structure is incorporated into the article of footwear. In some implementations, the sole structure is incorporated into an article of footwear.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

Referring to FIG. 1, an article of footwear 10 includes a sole structure 100 and an upper 200 attached to the sole structure 100. The footwear 10 may further include an anterior end 12 associated with a forward-most point of the footwear, and a posterior end 14 corresponding to a rearward-most point of the footwear 10. As shown in FIG. 1, a longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 corresponds with phalanges and metatarsal bones of a foot. The mid-foot region 22 may correspond with an arch area of the foot, and the heel region 24 may correspond with rear portions of the foot, including a calcaneus bone.

The sole structure 100 includes a midsole 102 configured to provide cushioning and support and an outsole 104 defining a ground-engaging surface (i.e., contacts the ground during a stance phase of a gait cycle) of the sole structure 100. Unlike conventional sole structures, which include monolithic midsoles and outsoles, the sole structure 100 of the present disclosure is configured as a composite structure including a plurality of components joined together. For example, and as described below, the sole structure 100 may include a plurality of cushioning structures or truss structures 120 interposed between the outsole 104 and a cover element 202 (e.g., a strobel) of the upper 200. The midsole 102 may be described as including an upper support surface 106 of the sole structure 100, which is configured to face the upper 200 and to support a plantar surface of the foot when the article of footwear 10 is donned by a wearer. The midsole also includes a ground-engaging surface 108 formed on an opposite side of the midsole 102 from the support surface 106. In the example shown in FIG. 1, the truss structures 120 cooperate to define portions of the upper support surface 106 and the ground-engaging surface 108. While the ground-engaging surface 108 of the midsole 102 may be exposed and directly contact the ground surface during use, in the illustrated example, the outsole 104 of the sole structure 100 is attached to the ground-engaging surface 108 and defines a ground-contacting surface of the sole structure 100.

Optionally, the sole structure 100 may include a peripheral wall 110 that extends between the support surface 106 and the ground-engaging surface 108 to enclose an outer periphery of the sole structure 100. In other words, the peripheral wall 110 cooperates with the outsole 104 and the cover 202 to define an interior void 112, within which the truss structures 120 are disposed between the upper 100 and the ground-engaging surface 108. In the illustrated example, the peripheral wall 110 is integrally formed with the outsole 104 as a continuous element. However, when present, the peripheral wall 110 may be a separate component attached to the sole structure 100.

With continued reference to FIG. 1, the illustrated example of the midsole 102 includes a plurality of the truss structures 120 arranged within the midsole 102 between the upper 200 and the outsole 104. As shown, the truss structures 120 may have different configurations. As shown, the midsole 102 may include a variety of different configurations of truss structures 120 that are selected based on desired cushioning and performance for a particular region of the sole structure 100. While the sole structure 100 shown in FIG. 1 is merely intended as a non-limiting example to show that the truss structures 120 may vary in size, shape, and structural design, the principles of the present disclosure are applicable regardless of the particular arrangement of the truss structures 120.

Figure 2A:
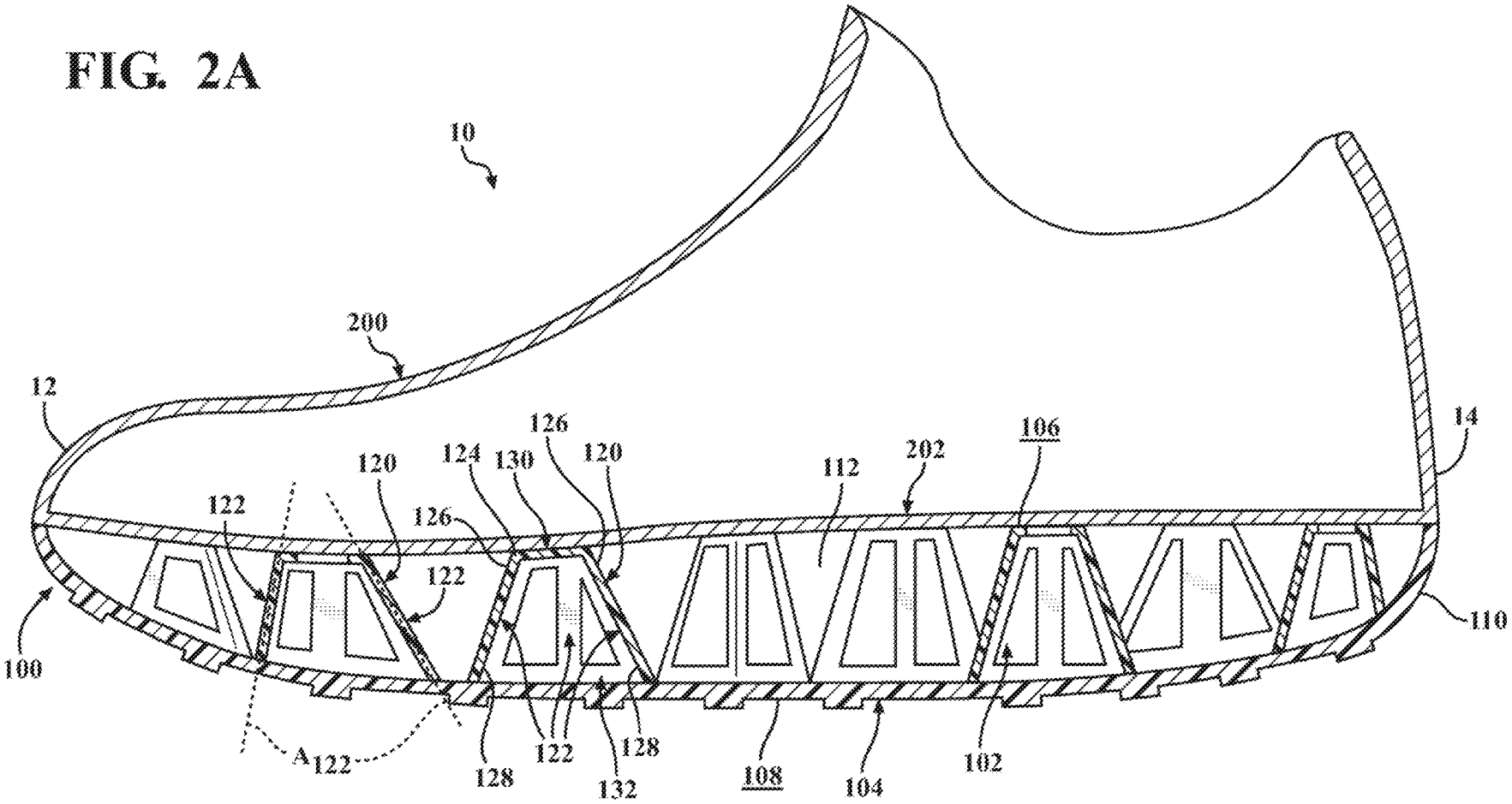
FIGS. 2A-2F show various examples of sole structures according the principles of the present disclosure.

Referring now to FIG. 2A, an example of the sole structure 100 of FIG. 1 is shown in cross-section to illustrate the interface between the truss structures 120 of the midsole 102 and each of the upper 200 and the outsole 104. As shown, each of the truss structures 120 includes a plurality of struts 122 extending continuously between the support surface 106 of the midsole 102 and the ground-engaging surface 108 of the midsole 102. In this example, each of the struts 122 extends continuously along a longitudinal axis $A_{122}$ from an upper distal end 126 at the support surface 106 to a lower distal end 128 at the ground-engaging surface 108. Here, one or more of the struts 122 may converge with each other along a direction extending between the support surface 106 and the ground-engaging surface 108. For example, in the illustrated configuration, the truss structures 120 include struts 122 having longitudinal axes $A_{122}$ that converge with each other along a direction from the ground-engaging surface 108 to the support surface 106. However, in other examples, one or more of the support elements 122 may converge along the direction from the support surface 106 to the ground-engaging surface 108.

Referring still to FIG. 2A, respective distal ends 126, 128 of two or more of the struts may intersect with each other at the support surface 106 and/or the ground-engaging surface 108. In some examples, discussed in greater detail below with respect to FIGS. 3A-7D, all of the struts 122 of the truss structure 120 converge and intersect at a single node 124 to form a pyramidal structure. However, in the example shown in FIG. 2A, the upper ends of the truss structures 120 are truncated, whereby upper distal ends 126 of the struts 122 of each truss structure 120 may intersect at a plurality of nodes 124 disposed at the support surface 106. Here, the plurality of nodes 124 of each truss structure 120 are connected to each other by upper chords to define a truss platform 130 at an upper end of each truss structure 120. The truss platforms 130 of the plurality of the truss structures 120 cooperate with each other to define the support surface 106. Thus, the heights and orientations of the truss platforms 130 may vary along the sole structure 100 to correspond to the profile of the plantar surface of the foot.

With continued reference to FIG. 2A, the lower distal ends 128 of the struts 122 may intersect at a plurality of nodes 124 disposed at the ground-engaging surface 108 of the midsole 102. Here, the plurality of nodes 124 of each truss structure 120 are connected to each other by lower chords to define a truss base 132 at a lower end of each truss structure 120. The truss bases 132 of the plurality of the truss structures 120 cooperate with each other to define the ground-engaging surface 108. Thus, the profiles and orientations of the truss bases 132 may vary along the sole structure to correspond to the ground-engaging surface 108.

As provided above, the truss structures 120 are arranged within the midsole 102 such that the struts 122 extend continuously between the support surface 106 and the ground-engaging surface 108. In other words, each strut 122 only includes a pair of attachment points, one at each of the distal ends 126, 128 such that an intermediate portion (i.e., the portion extending between the distal ends 126, 128 of each strut 122) is unconstrained and is free to flex or bend. Thus, each strut 122 may be configured to act as a mechanical spring element, whereby a combination of the geometry and the material of the strut 122 is selected to impart desired properties of cushioning and responsiveness. Various configurations of struts 122 and the associated properties are discussed in greater detail below with respect to FIGS. 3A-7C.

Figure 2B:
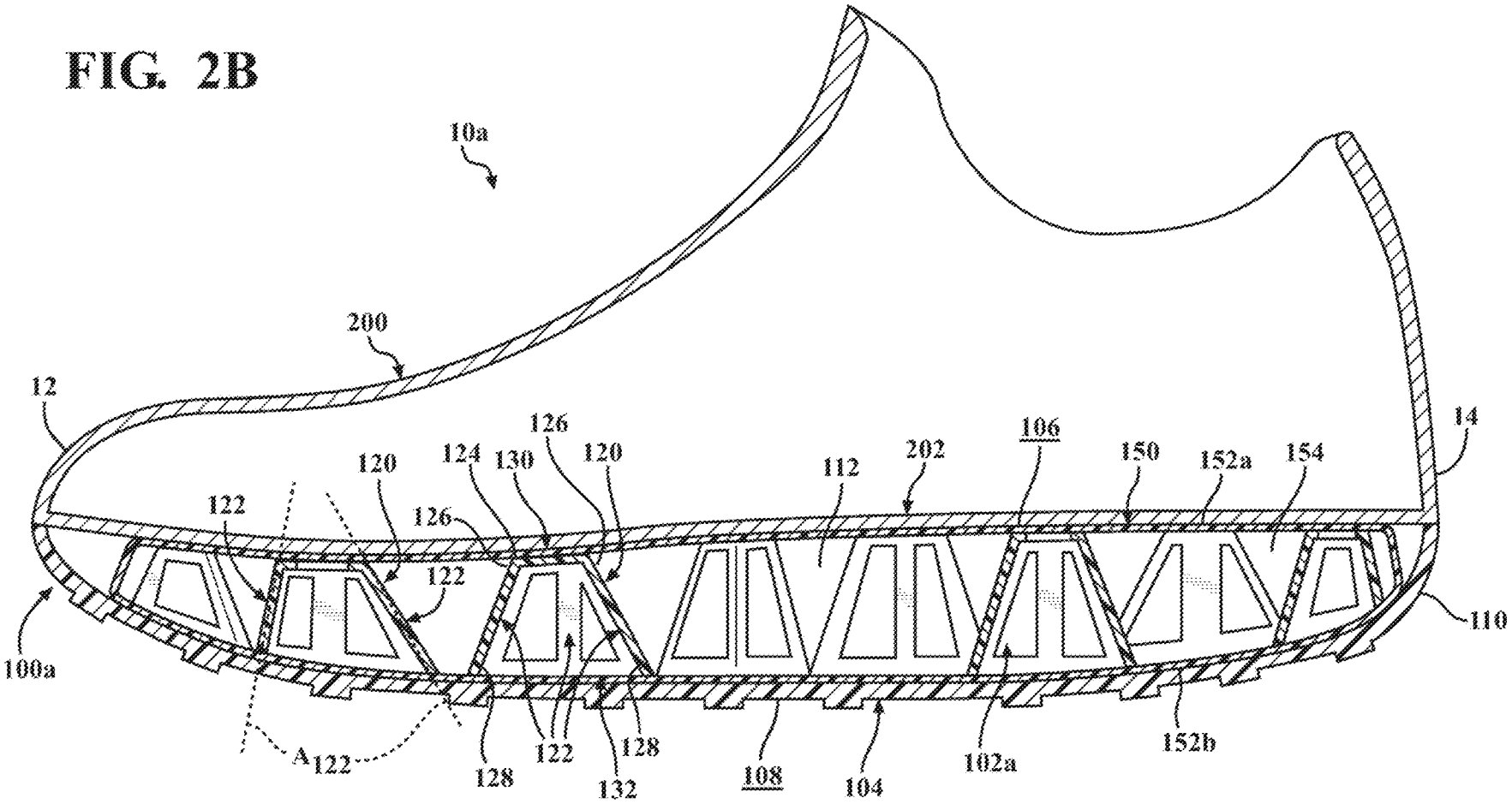

With particular reference to FIG. 2B, an article of footwear 10*a* is provided and includes a sole structure 100*a* and the upper 200 attached to the sole structure 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

In the example of the sole structure 100*a* shown in FIG. 2B, the midsole 102*a* includes a bladder 150 disposed within the interior void 112 of the sole structure 100. The bladder 150 of the midsole 102*a* includes an opposing pair of barrier sheets 152*a*, 152*b*, which can be joined to each other at discrete locations to define a chamber 154. In the shown configuration, the barrier sheets 152*a*, 152*b* include a first, upper barrier sheet 152*a* and a second, lower barrier sheet 152*b*. Alternatively, the chamber 154 can be produced from any suitable combination of one or more barrier sheets.

The chamber 154 can be provided in a fluid-filled (e.g., as provided in footwear 10) or in an unfilled state. The chamber 154 can be filled to include any suitable fluid, such as a gas or liquid. In an aspect, the gas can include air, nitrogen ($N_2$), or any other suitable gas. In other aspects, the chamber 154 can alternatively include other media, such as pellets, beads, ground recycled material, and the like (e.g., foamed beads and/or rubber beads). The fluid provided to the chamber 154 can result in the chamber 154 being pressurized. Alternatively, the fluid provided to the chamber 154 can be at atmospheric pressure such that the chamber 154 is not pressurized but, rather, simply contains a volume of fluid at atmospheric pressure.

In the illustrated example, an outer surface of the upper barrier sheet 152*a* faces the upper and defines the support surface 106 of the midsole 102*a*. Conversely, an outer surface of the lower barrier sheet 152*b* faces the outsole 104 and defines the ground-engaging surface 108 of the midsole 102. Each of the barrier sheets 152*a*, 152*b* further includes an inner surface formed on an opposite side from the respective outer surfaces. Here, the platform 130 of each of the truss structures 120 is attached to the inner surface of the upper barrier sheet 152*a* and the base 132 of each of the truss structures 120 is attached to the inner surface of the lower barrier sheet 152*b*.

In use, the truss structures 120 and the bladder 150 cooperate to provide a cushioning component to the sole structure 100*a*. For instance, the midsole 102*a* may be tuned such that the truss structures 120 provide a first stage of cushioning when a first load is applied to the support surface 106 by the foot and the bladder 150 provides a second stage of cushioning when a second load that is different than the first load is applied to the support surface 106.

Figure 2C:
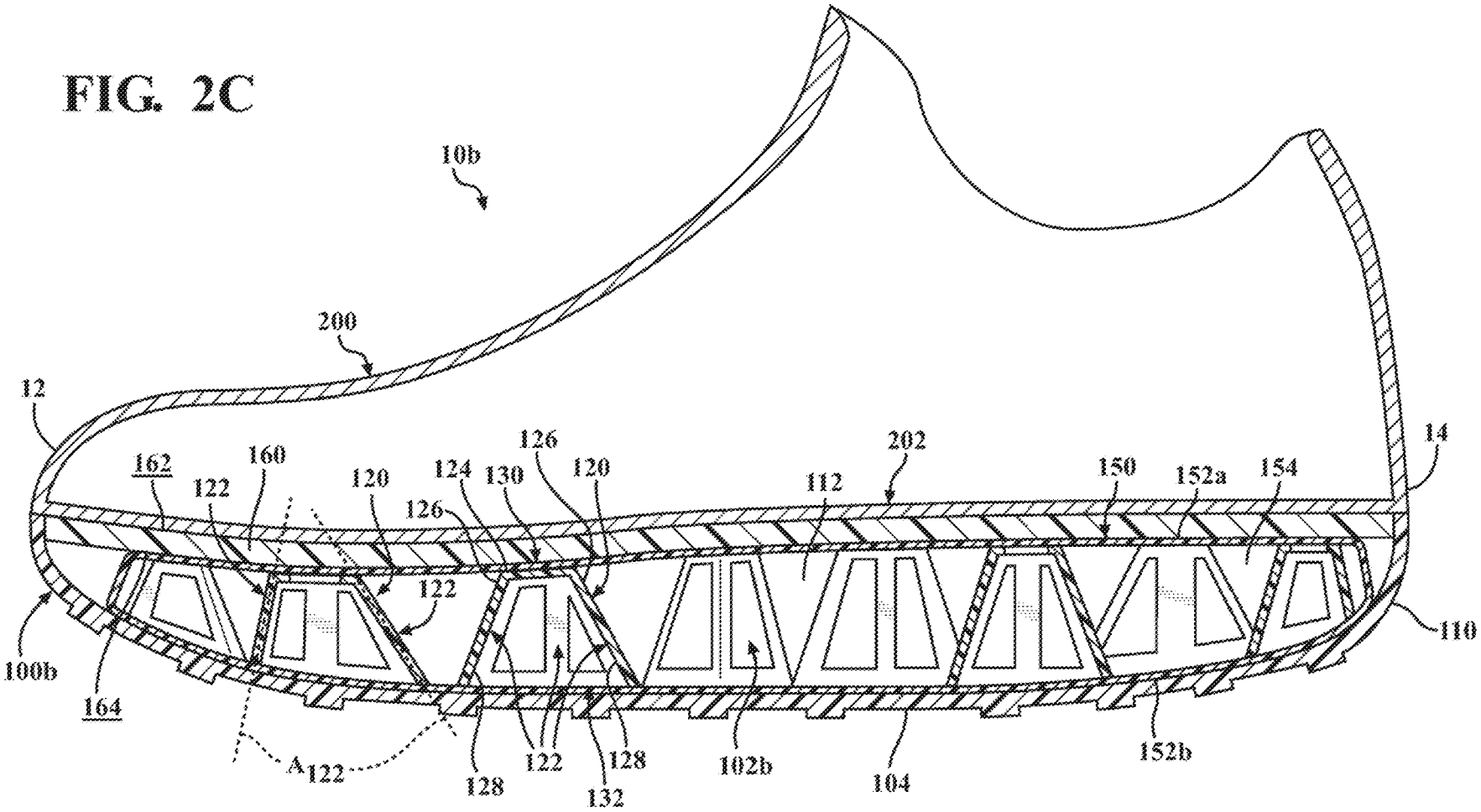

With particular reference to FIG. 2C, an article of footwear 10*b* is provided and includes a sole structure 100*b* and the upper 200 attached to the sole structure 100*b*. In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

In the example of the sole structure 100*b* of FIG. 2C, the midsole 102*b* further includes a foam cushioning element 160 disposed between the upper 200 and the upper barrier sheet 152*a* of the bladder 150. More specifically, the cushioning element 160 includes an upper surface 162 and a lower surface 164 formed on an opposite side from the upper surface 162. Here, the upper surface 162 faces the upper 200 and defines the support surface 106 of the midsole 102*b* while the lower surface 164 faces the upper barrier sheet 152*a*. A thickness of the cushioning element 160 is measured from the upper surface 162 to the lower surface 164. In the illustrated example, the cushioning element 160 has a constant thickness extending from the anterior end 12 to the posterior end 14 and from the medial side 16 to the lateral side 18. Thus, the cushioning element 160 defines an entirety of the support surface 106 of the midsole 102*b*. However, in other examples, the cushioning element 160 may be provided as an intermittent, fragmentary, or zonal structure, whereby the cushioning element 160, or fragments thereof, are only provided in specific regions of the midsole 102*a*. Additionally or alternatively, the cushioning element 160 may be provided with a varying thickness in different regions of the midsole.

In use, the cushioning element 160 provides a cushioning buffer between the support surface 106 and the platforms 130 of the truss structures 120. Thus, the cushioning element 160 may dampen and/or distribute responsive point loads associated with the platforms 130 to provide a relatively constant load along the plantar surface of the foot when the midsole 102*b* is loaded.

Figure 2D:
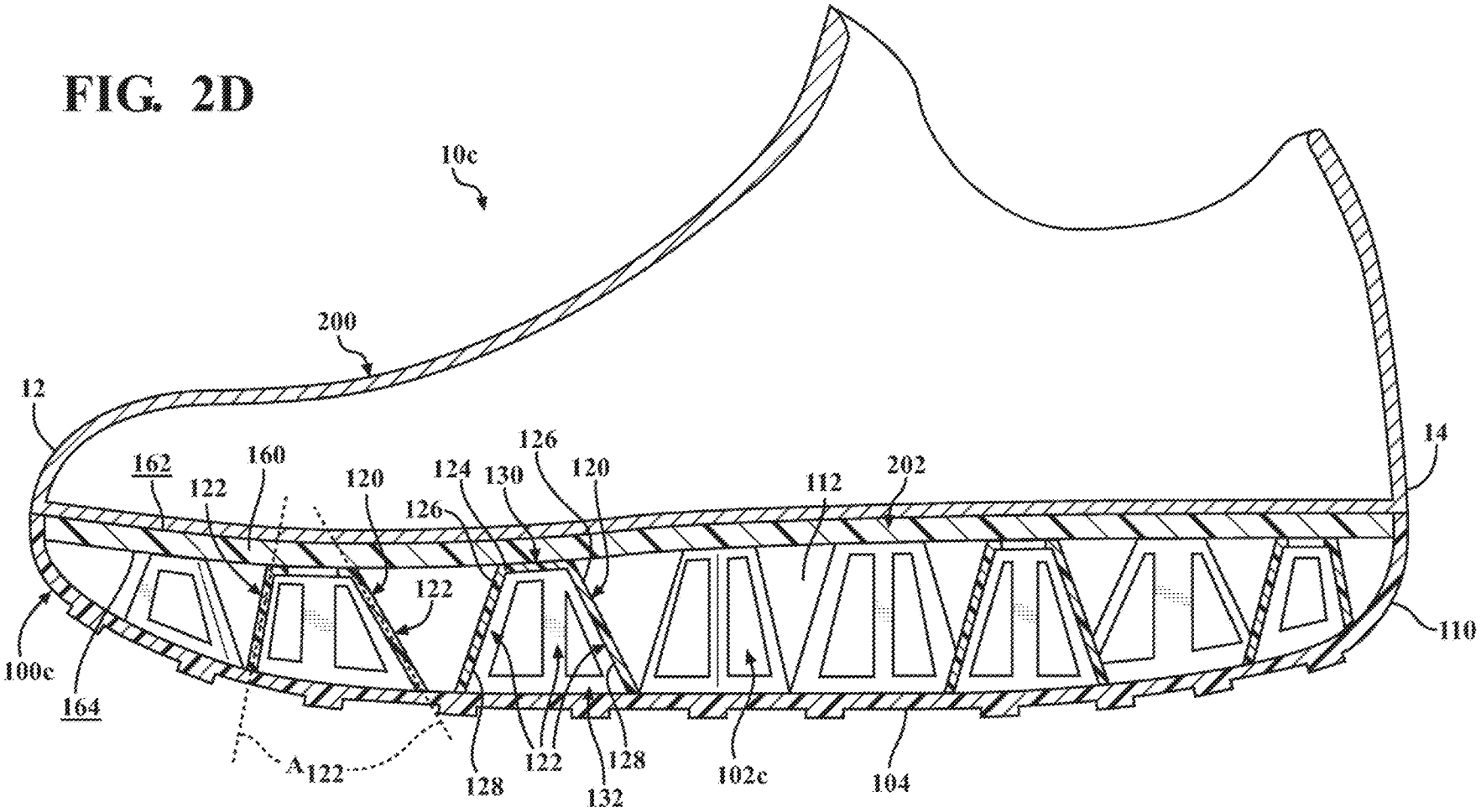

With particular reference to FIG. 2D, an article of footwear 10*c* is provided and includes a sole structure 100*c* and the upper 200 attached to the sole structure 100*c*. In view of the substantial similarity in structure and function of the components associated with the article of footwear 10 with respect to the article of footwear 10*c*, like reference numerals are used hereinafter and in the drawings to identify like components while like reference numerals containing letter extensions are used to identify those components that have been modified.

In the example of the midsole 102*c* shown in FIG. 2D, the bladder 150 is omitted and the cushioning element 160 is attached directly to the platforms 130 of the truss structures 120. Here, the cushioning element 160 provides the same load dampening and distribution as discussed previously, while the primary cushioning function of the midsole 102*c* is provided by the truss structures 120.

Figure 2E:
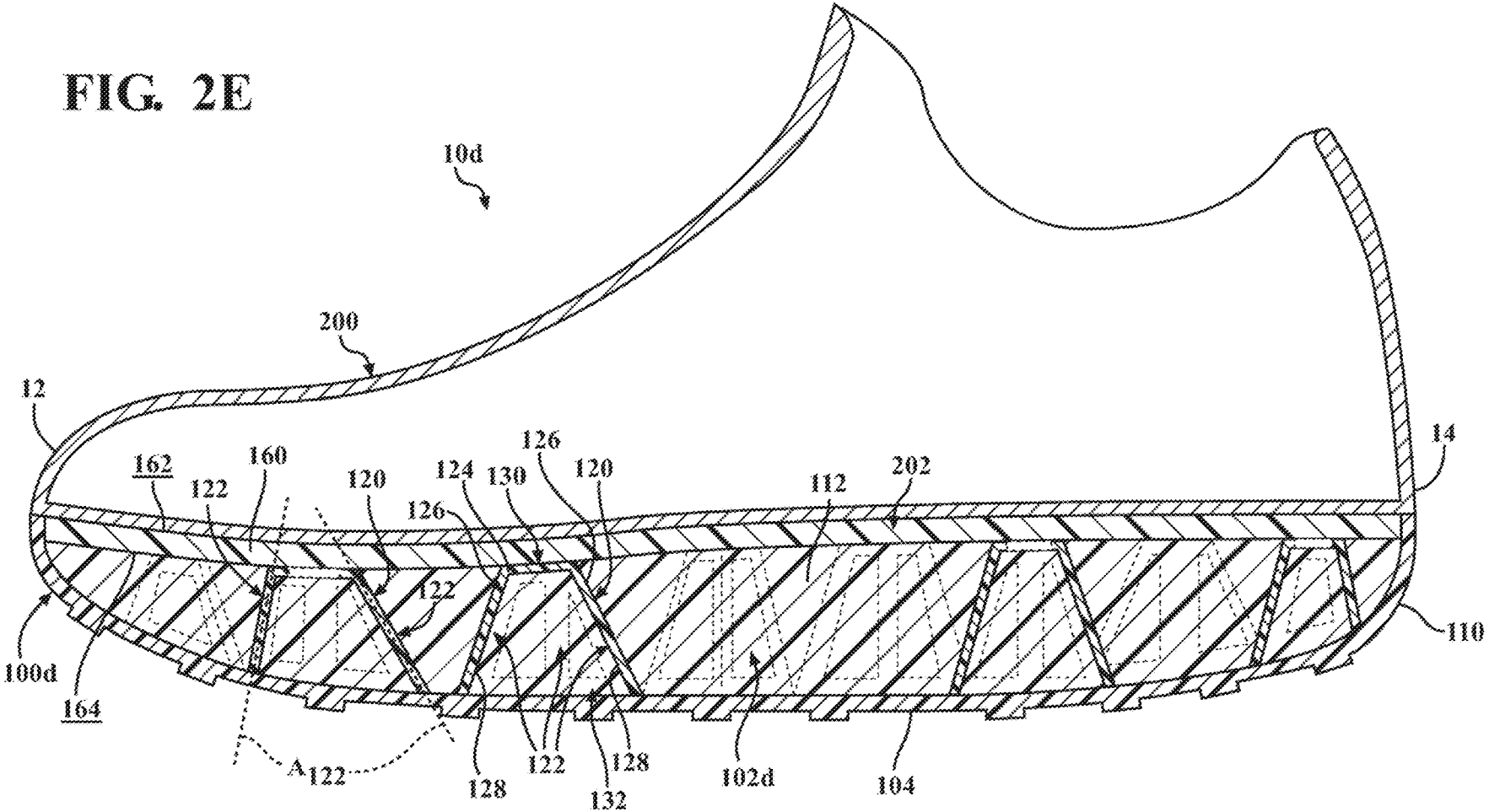

With particular reference to FIG. 2E, an article of footwear 10*d* is provided and includes a sole structure 100*d* and the upper 200 attached to the sole structure 100*d*. In view of the substantial similarity in structure and function of the components associated with the article of footwear 10 with respect to the article of footwear 10*d*, like reference numerals are used hereinafter and in the drawings to identify like components while like reference numerals containing letter extensions are used to identify those components that have been modified.

In this example, the interior void 112 of the midsole 102*d* includes a foam cushioning component 170 in addition to the truss structures 120. Here, the foam cushioning component 170 may fill the interior void 112 of the midsole 102*d* such that the truss structures 120 are encapsulated or embedded within a material of the cushioning component 170. Like the examples of the midsoles 102*a*, 102*b* including the bladder 150, the cushioning component 170 cooperates with the truss structures 120 to provide multi-stage cushioning, whereby the truss structures 120 provide a first stage of cushioning when a first load is applied to the support surface 106 by the foot and the cushioning component 170 provides a second stage of cushioning when a second load that is different than the first load is applied to the support surface 106. Additionally, the upper cushioning element 160 may be omitted or integrally formed as part of the cushioning component 170 such that the cushioning component 170 defines at least a portion of the support surface 106.

Figure 2F:
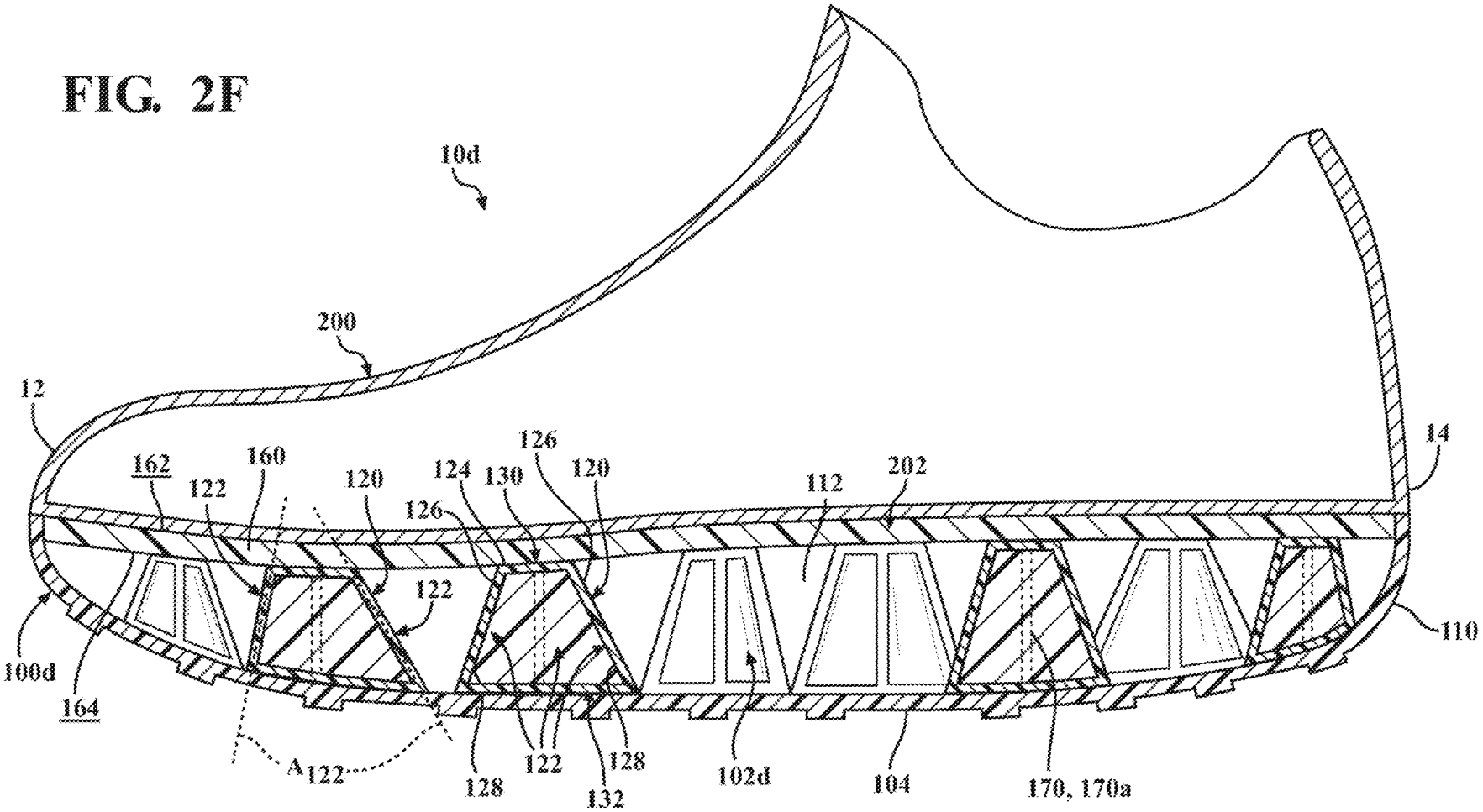

While the cushioning component 170 is shown as filling the entirety of the interior void 112, the cushioning component 170 may be provided as a fragmentary or zonal component, whereby the cushioning component 170 is disposed in specific regions of the midsole 102*d*. For example, with continued reference to FIG. 2E, the cushioning component 170 may be described as including interior portions 170*a* that are disposed or formed within each truss structure 120 and/or exterior portions 170*b* that are disposed or formed around each truss structure 120. While, the interior portions 170*a* and the exterior portions 170*b* are formed as an integral component 170 encompassing all of the truss structures 120 (i.e., the struts are embedded between the interior portion 170*a* and the exterior portion 170*b*), in other examples, the interior portion 170*a* and the exterior portion 170*b* may be formed as separate elements and/or of different materials. Additionally or alternatively, portions of the interior component 170*a* and/or the exterior component 170*b* may be omitted. For instance, and as shown in FIG. 2F, the midsole 102*d* may be formed with a cushioning component 170 that only includes the interior components 170*a* disposed or formed within the truss structures 120, whereby the spaces formed around the exteriors of the truss structures 120 (i.e., the spaces separating adjacent truss structures 120) are empty or filled will a fluid.

Figure 3A:
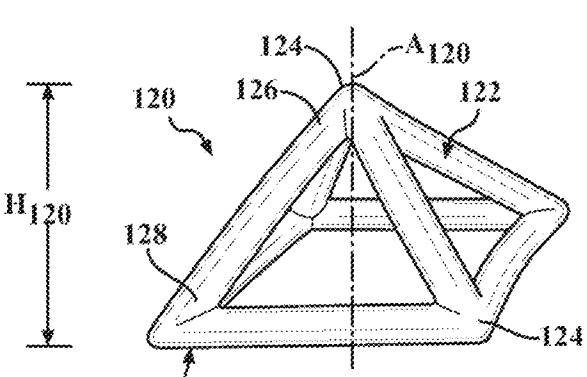
FIG. 3A shows an example truss structure for a sole structure according to the principles of the present disclosure, where the truss structure is in a natural state.
Figure 3B:
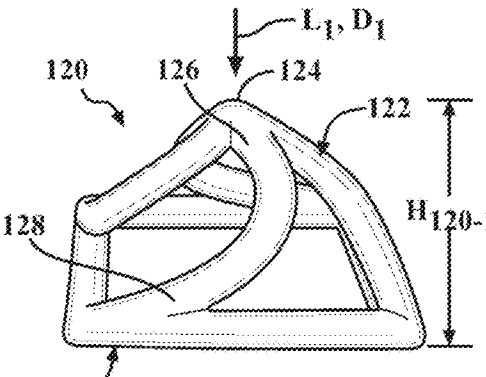
FIG. 3B shows the truss structure of FIG. 3A in a first loaded state.
Figure 3C:
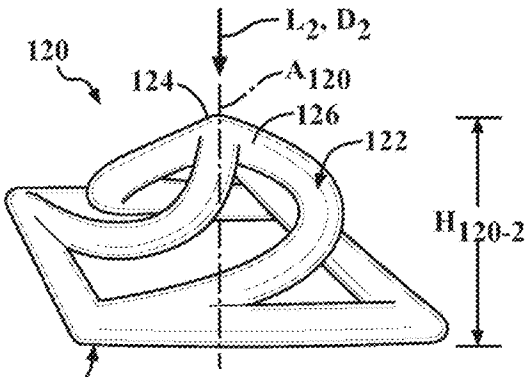
FIG. 3C shows the truss structure of FIG. 3B in a second loaded state.

Referring to FIGS. 3A-3C, a representative example of the reaction of the truss structures 120 in response to a load L is illustrated. In this example, the truss structures 120 are formed as four-sided pyramids including a square base 132*a* and four struts 122 each extending from a lower distal end 128 attached at a respective node 124 formed at a corner of the base 132*a* to an upper distal end 126 attached to a common upper node 124. However, the principles illustrated in FIGS. 3A-3C would apply to truss structures 120 having other configurations discussed herein. In FIG. 3A, the truss structure 120 is shown in a natural or relaxed state, wherein no external loads L (e.g., compression by foot) are applied to the truss structure 120 and the truss structure 120 has a height $H_{120}$ measured from the base 132 to the upper node 124. Here, the struts 122 are each in a straight, non-deformed state between the base 132 and the upper node 124.

In FIG. 3B, the truss structure 120 is shown in a first reactive state, whereby a first compressive load $L_1$ is applied to the upper node 124 along the direction of the axis $A_{120}$. Under the first load $L_1$, the upper node 124 is displaced by a distance $D_1$ and the truss structure 120 is compressed to a reduced height $H_{120\text{-}1}$ corresponding to the first load $L_1$. Described differently, when the load $L_1$ is applied to the upper node 124, the load $L_1$ is distributed among each of the struts 122 and is transferred along the longitudinal axes $A_{122}$ of each to each of the struts 122 to the base 132. As the load $L_1$ increases, the struts 122 react by bending or deflecting along their respective axes $A_{122}$. In other words, each strut 122 is caused to bow along its length between the upper distal end 126 and the lower distal end 128. This deflection may result in a reactive twist between the upper node 124 or platform 130 and the base 132. As illustrated, the reactive twist angles $\beta_{122}$ are measured as angles about the axis $A_{120}$ and between (i) a vertical plane $P_{120}$ extending through a given lower node 124 of the base 132 and the axis $A_{120}$ and (ii) the upper distal end 126 of the strut 122 associated with the given lower node 124. FIG. 3C illustrates the truss structure 120 in a second reactive state, whereby a second compressive load $L_2$ is applied to the upper node 124. Under the second compressive load $L_2$, the upper node 124 is displaced by a second distance $D_2$ and the reactive twist angles $\beta_{122}$ increase further.

Figure 4A:
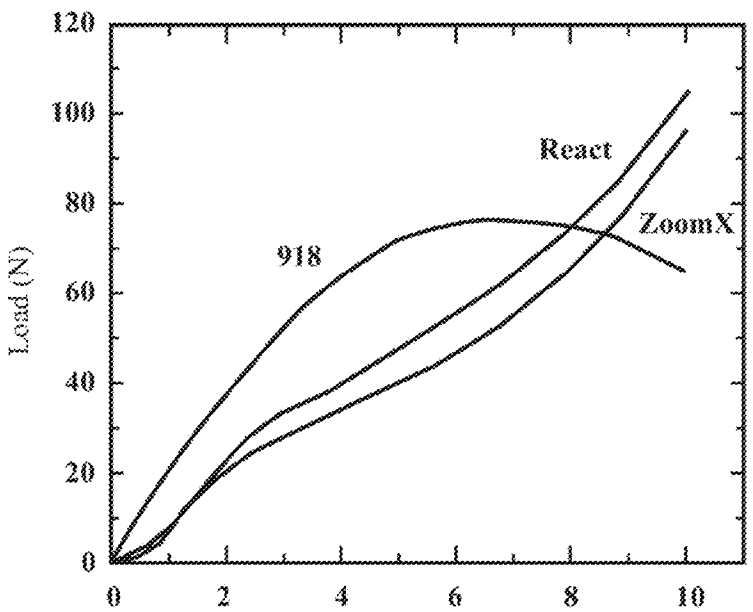
FIG. 4A shows a graph illustrating the measured relationship between load and displacement for each of (i) a truss structure according to the principles of the present disclosure, (ii) a first foam material, and (iii) a second foam material.
Figure 4B:
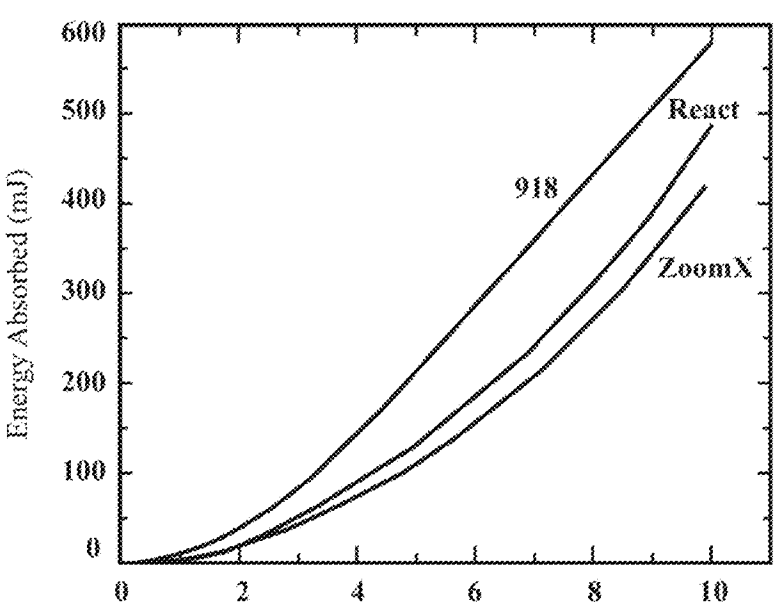
FIG. 4B shows a graph showing the measured relationship between absorbed energy and displacement for each of (i) a truss structure according to the principles of the present disclosure, (ii) a first foam material, and (iii) a second foam material.

The truss structures 120 are configured to provide a structural cushioning component, whereby the cushioning characteristics are defined by the structural properties of the struts 122. As shown in FIGS. 4A and 4B, this mechanical response provides favorable performance characteristics compared to conventional foam cushioning elements that rely solely on material compression properties. For example, FIG. 4A illustrates representative testing data showing that the load L applied to an example truss structure 120 remains within a limited range (e.g., approximately 60-80 Newtons) across a wide displacement range (e.g., 4-10 mm), while foam cushioning elements experience continuously increasing loads (e.g., from approximately 35 Newtons up to approximately 100 Newtons) across the same range of displacement.

Referring now to FIGS. 5A-5D, an example of a tunable characteristic for the truss structures 120 is illustrated. In the illustrated examples, three variations of truss structures 120*a*-120*c* are provided having different strut angles $\theta_{120a}$-$\theta_{120c}$ relative to a plane defined by the base 132*a*. Changing the strut angle $\theta_{120}$ directly corresponds to the proportion of the compressive load L that is transferred along each strut as (a) an axial load (i.e., along the length) or (b) a bending load. In other words, decreasing the strut angle $\theta_{120}$ causes a larger proportion of the compressive load L to be applied to the strut 122 as a bending load, thereby reducing the magnitude of the compressive load L required to induce bending or displacement. Thus, as shown in the graph of FIG. 5D, modifying the strut angles $\theta_{120}$ of the truss structure 120 changes a load-to-displacement ratio for the truss structure 120. For example, at a given displacement, a truss structure 120*a* with struts 122 oriented at 45° strut angles $\theta_{120a}$ experiences a greater load than a truss structure 120*c* with struts 122 oriented at 35° strut angles $\theta_{120c}$. Accordingly, a desired strut angle may be selected based on the desired cushioning characteristics for a particular region of the midsole 102.

Figure 6C:
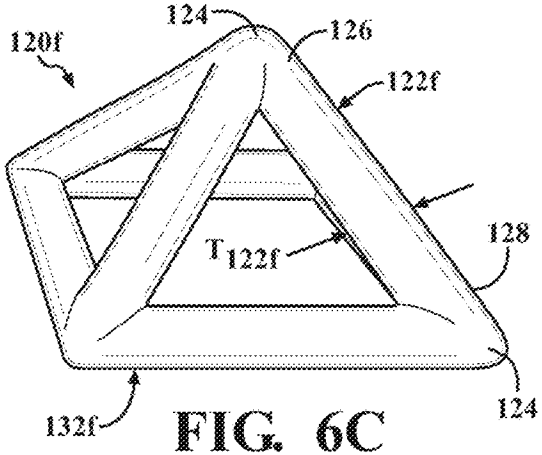
FIGS. 6A-6C show examples of truss structures having different strut thicknesses according to the principles of the present disclosure.
Figure 6B:
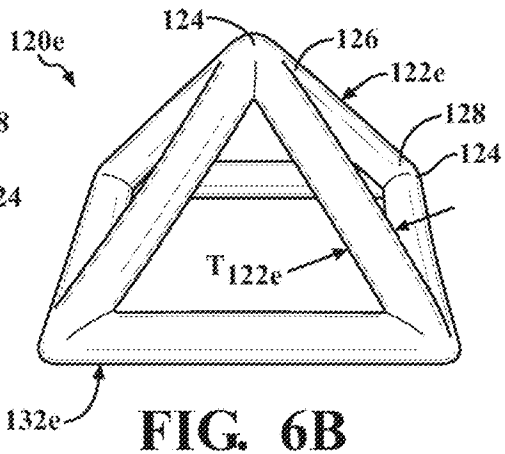
Figure 6A:
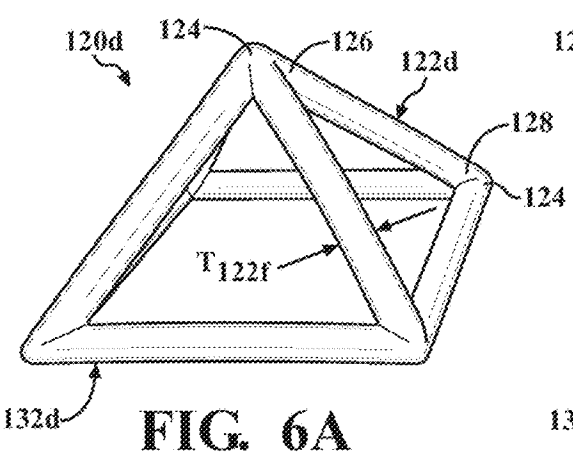
Figure 6D:
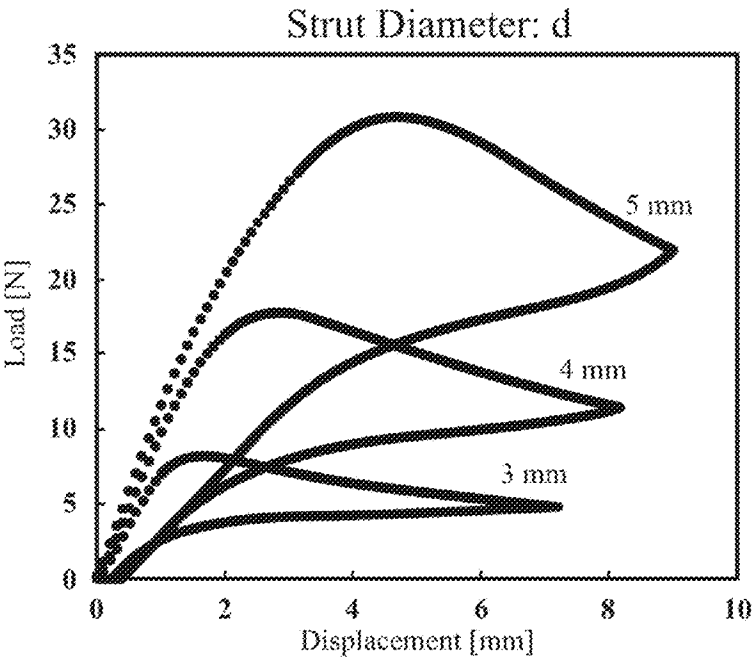
FIG. 6D shows a graph illustrating the measured effect of strut thickness on the relationship between displacement and load for the example truss structures of FIGS. 6A-6C.

Referring now to FIGS. 6A-6D, another example of a tunable characteristic for the truss structures 120 is illustrated. In the illustrated examples, three variations of truss structures 120*d*-120*f* are provided having different strut thicknesses $T_{122d}$-$T_{122f}$. In this example, each of the struts 122*d*-122*f* includes a substantially cylindrical shape such that the thicknesses $T_{122a}$-$T_{122c}$ correspond to a diameter. However, as discussed below, different strut profiles may be used, such as polygonal or irregular profiles. As shown in the graph of FIG. 6D, modifying the strut thicknesses $T_{122}$ of the truss structure 120 changes a load-to-displacement ratio for the truss structure 120. Thus, a truss structure 120*d* with struts 122 having a 5 mm diameter has a higher load-to-displacement ratio than a truss structure 120*f* with struts 122 having a 3 mm diameter. Accordingly, a desired strut thickness may be selected based on the desired cushioning characteristics for a particular region of the midsole 102.

Figure 7A:
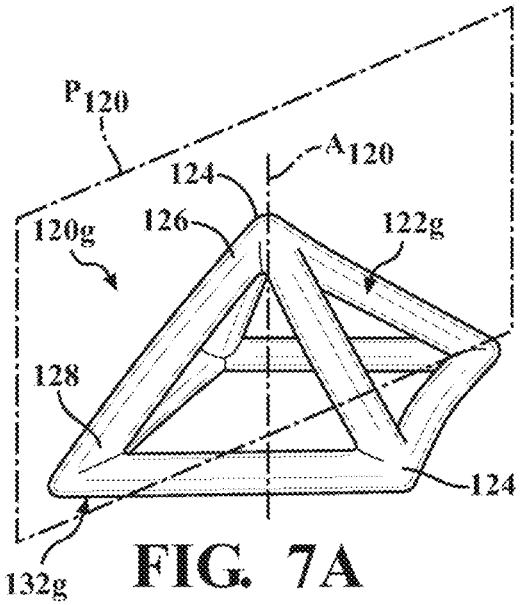
FIGS. 7A-7D show examples of truss structures having different twist angles according to the principles of the present disclosure.
Figure 7B:
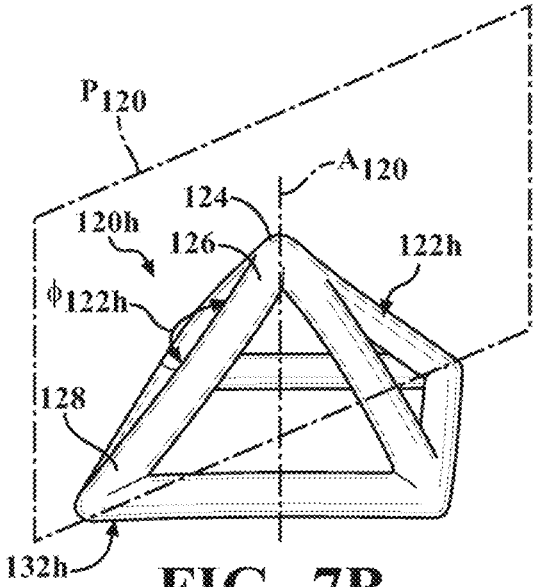
Figure 7C:
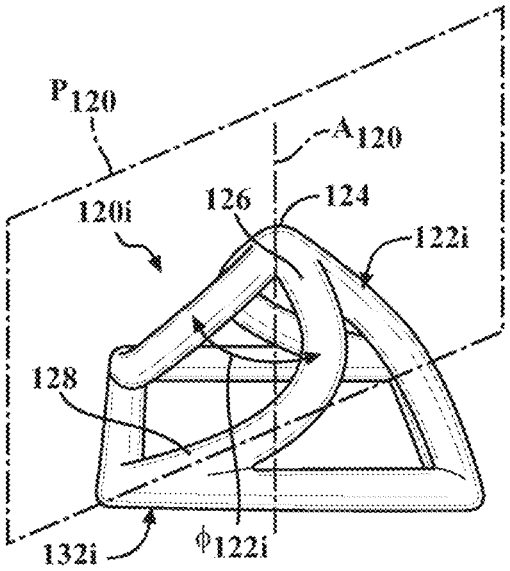
Figure 7D:
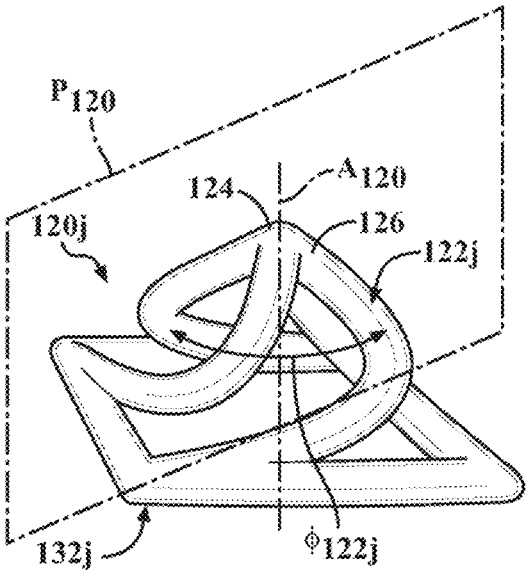
Figure 7E:
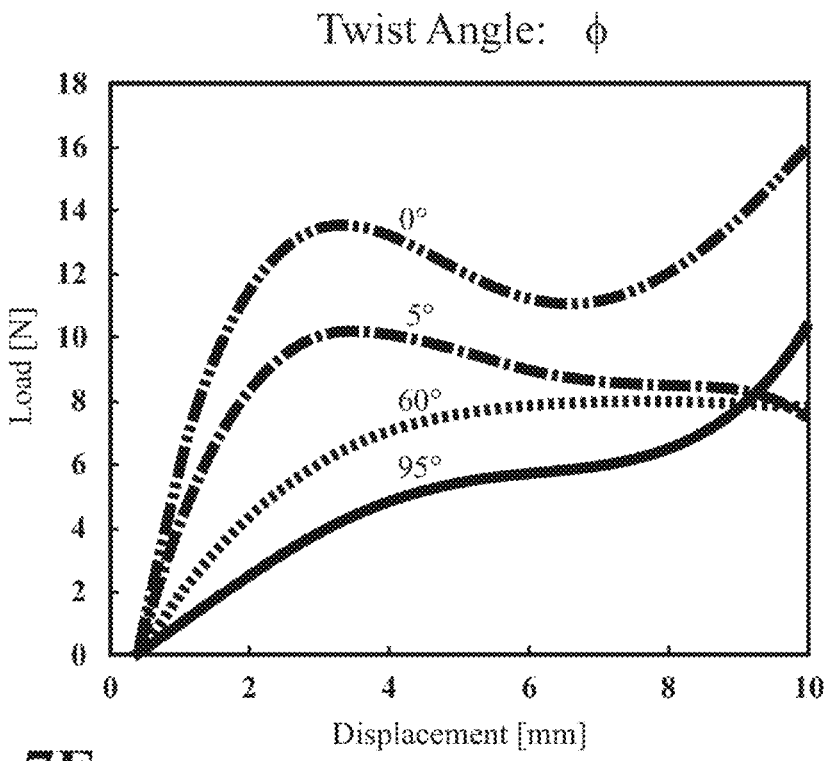
FIG. 7E shows a graph illustrating the measured effect of twist angle on the relationship between displacement and load for the example truss structures of FIGS. 7A-7D.

Referring now to FIGS. 7A-7E, another example of a tunable characteristic for the truss structures 120 is illustrated. In the illustrated examples, four variations of truss structures 120*g*-120*j* are provided having different pre-twist angles $\Phi_{122}$. The pre-twist angle $\Phi_{122}$ is defined as an angle of rotation of the platform 130 (the upper node 124) relative to the base 132 about a vertical axis $A_{120}$ of the truss structure 120. For example, the truss structure 120*g* shown in FIG. 7A has a pre-twist angle $\Phi_{122g}$ of 0°, whereby each of the struts 122 extends straight from the base 132*g* to the platform 130*g*. By comparison, the truss structures 120*h*-120*i* have respective pre-twist angles $\Phi_{122h}$-$\Phi_{122i}$ of 5°, 60°, and 95°. The pre-twist angles $\Phi_{122h}$-$\Phi_{122i}$ are measured as angles about the axis $A_{120}$ and between (i) a vertical plane $P_{120}$ extending through a given lower node 124 of the base 132 and the axis $A_{120}$ and (ii) the upper distal end 126 of the respective strut 122 associated with the given lower node 124. As shown in the graph of FIG. 7D, modifying the pre-twist angle $\Phi_{122}$ of the truss structure 120 changes a ratio of load-to-displacement for the truss structure 120. Thus, a truss structure 120*g* with a pre-twist angle $\Phi_{122g}$ of 0° has a higher load-to-displacement ratio than a truss structure 120*j* with a pre-twist angle $\Phi_{122j}$ of 95°. Accordingly, a desired pre-twist angle $\Phi_{122}$ may be selected based on the desired cushioning characteristics for a particular region of the midsole 102.

Figure 8B:
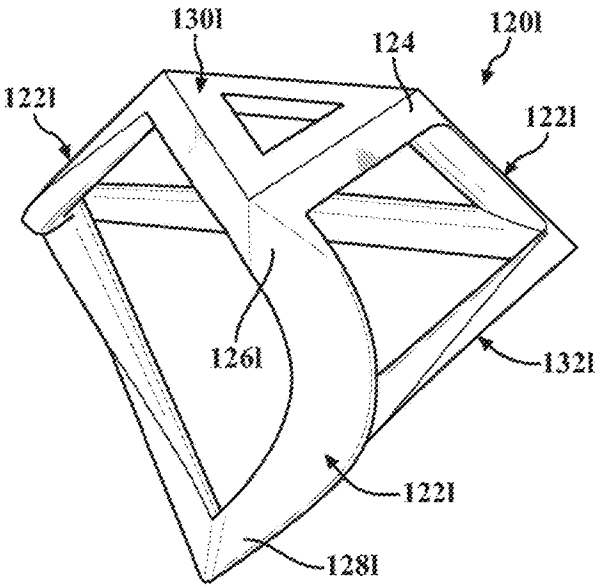
FIGS. 8A-8C show examples of truss structures having different combinations of tuning characteristics.
Figure 8A:
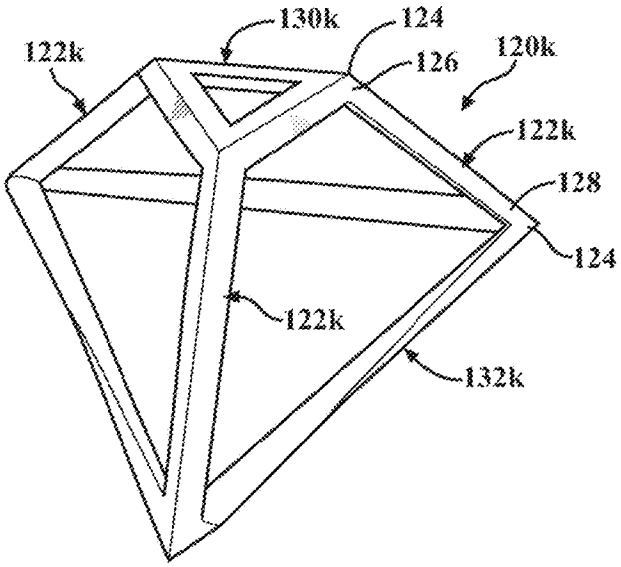
Figure 8C:
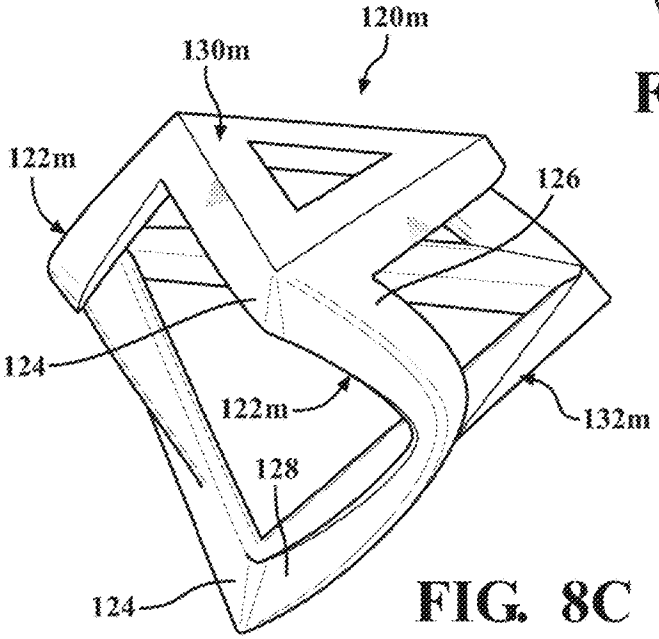

Referring now to FIGS. 8A-8C, examples of truss structures 120*k*-120*m* having combinations of the aforementioned tunable characteristics are provided. For example, the first example of the truss structure 120*k* includes struts $\mathbf{122}_k$ with polygonal cross-sections having a first thickness $T_{122}$ and each extending along respective straight strut axes. In another example, the truss structure 120*l* has struts 122*l* with polygonal cross-sections having a second thickness $T_{122}$ and a first pre-twist angle $\Phi_{122}$. In another example, the truss structure 120*m* has struts 122*m* with polygonal cross-sections having a third thickness $T_{122}$ and a second pre-twist angle $\Phi_{122}$.

Figure 9A:
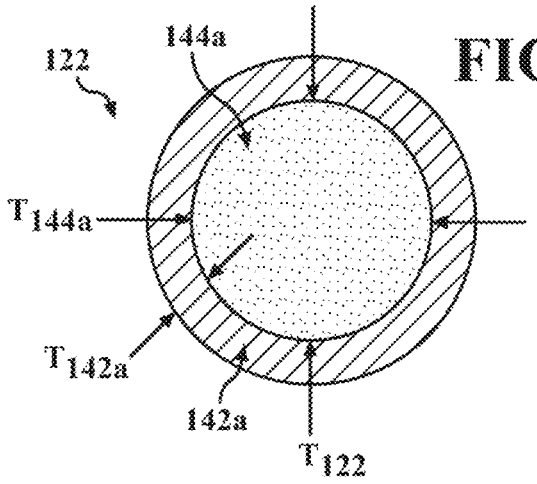
FIGS. 9A and 9B show example cross sections of struts for truss structures according to the principles of the present disclosure.
Figure 9B:
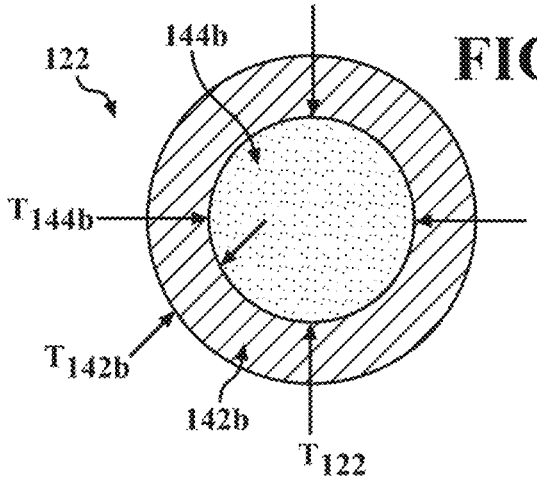

FIGS. 9A and 9B show examples of constructions for the truss structures 120 for use in any of the foregoing configurations shown in FIGS. 1-8C. While the illustrated examples represent cross sections of cylindrical struts 122, the construction principals described here would also apply to other elements of the truss structure 120 (e.g., upper and lower chords of the platform and base) and to elements having non-cylindrical profiles (e.g., polygonal or irregular). With particular reference to FIG. 9A, the strut 122 is formed of a foamed material and includes an outer sheath 142*a* having a first thickness $T_{142a}$ and an inner core 144*a* enclosed within the sheath 142*a* and having a second thickness $T_{142a}$. FIG. 9B provides another example construction for the strut 122, where the strut 122 is provided with a sheath 142*b* having a thickness $T_{1426}$ that is greater than the thickness $T_{142a}$ of the sheath 142*a* of the example of FIG. 9A and the a core 144*b* having a thickness $T_{144b}$ that is less than the thickness $T_{144a}$ of the core 144*a* of FIG. 9A. FIGS. 9A and 9B are merely provided as examples of how the relative thicknesses of the sheaths 142*a*, 142*b* and cores 144*a*, 144*b* can be modified to tune the cushioning properties of the struts 122. As discussed in the Materials section provided below, the sheath 142*a* and the core 144*a* may include the same or different material components, but have different material properties. For example, the sheath 142*a* may have a different density than the core 144*a*. Specifically, the sheath 142*a* may have a greater density than the core 144*a*, whereby the sheath 142*a* provides structural integrity to the strut 122 and the core provides a lightweight filler material.

While these examples provide representative illustrations of various combinations of tunable characteristics for the truss structures 120, other examples of the truss structures may include any combination of strut angles $\theta_{120}$, thicknesses $T_{122}$, and pre-twist angles $\Phi_{122}$. Additionally, respective struts 122 of each truss structure 120 may be individually configured with any of these tunable characteristics. For example, a first strut 122 of a truss structure 120 may include a first combination of tunable characteristics and a second strut 122 of the same truss structure 120 may include a second combination of tunable characteristics.

Materials

The struts 122 (e.g., the first strut, the second strut, etc.), the composite structures (e.g., sheath 142, core 144) comprising these struts 122, and/or the other cushioning elements 160, 170 may be made using polymeric materials (e.g., a polymeric first sheath material, a polymeric first core material, a polymeric second sheath material, a polymeric second core material, a polymeric filler material, etc.). Accordingly, the polymeric materials described herein are understood to comprise, consist essentially of, or consist of one or more polymers. All the one or more polymers present in a polymeric material constitute the polymeric component of the polymeric material. Similarly, when a polymeric material comprises one or more non-polymer additives, all of the non-polymeric additives present in the polymeric material constitute the non-polymeric component of the polymeric material. The one or more polymers of a polymeric material may comprise, consist essentially of, or consist of thermoplastics. A thermoplastic is a polymer that is a solid when cooled, and which can be repeatedly softened and melted on heating. The one or more polymers of a polymeric material may comprise, consist essentially of, or consist of elastomers. An elastomer may be defined as a polymer having an elongation at break greater than 100 percent, or greater than 200 percent, or greater than 400 percent, as determined using ASTM D-412-98 at 25 degrees Celsius. An elastomeric material may be defined as a composition having an elongation at break greater than 100 percent, or greater than 200 percent, or greater than 400 percent, as determined using ASTM D-412-98 at 25 degrees Celsius.

The one or more polymers of a polymeric material may include one or more of a variety of polymers, including homopolymers and copolymers and combinations of homopolymers and copolymers. The one or more polymers may comprise, consist essentially of, or consist of a polymer chosen from a polyurethane, a polyurea, a polyester, a polyether, a polyamide, a polyimide, a polyolefin, a polystyrene, a polysiloxane, a polycarbonate, a polyacetate, and any combination thereof, including homopolymers and copolymers thereof. The one or more polymers may comprise, consist essentially of, or consist of a polymer chosen from a polyurethane, a polyester, a polyamide, a polystyrene, a polyolefin, and any combination thereof, including homopolymers and copolymers thereof. The one or more polymers may comprise, consist essentially of, or consist of polyurethanes. Examples of polyurethanes include thermoplastic polyurethanes (TPUs), such as polyester-polyurethane copolymers and polyether-polyurethane copolymers, including thermoplastic elastomeric polyurethanes. The one or more polymers may comprise, consist essentially of, or consist of polyesters. Examples polyesters include polyester homopolymers such as polyethylene terephthalate (PET), and polyester copolymers such as polyetheresters, including thermoplastic polyester copolymers. The one or more polymers may comprise, consist essentially of, or consist of polyamides. Examples of polyamide homopolymers include thermoplastic polyamide homopolymers such as Nylon-6, Nylon-6,6, and Nylon-11. Examples of polyamide copolymers include thermoplastic polyamide copolymers such as thermoplastic elastomeric polyamide block copolymers, for example polyether block amide (PEBA) thermoplastic elastomers. The one or more polymers may comprise, consist essentially of, or consist of polystyrenes. Examples of polystyrenes include thermoplastic polystyrene homopolymers such as thermoplastic polystyrene homopolymer elastomers. Examples of polystyrenes also include thermoplastic polystyrene copolymers such as thermoplastic polystyrene copolymer elastomers, for example, a styrene-butadiene-styrene (SBS) copolymer or a styrene-ethylene-butadiene-styrene (SEBS) copolymer. The one or more polymers may comprise, consist essentially of, or consist of polyolefins. Examples of polyolefins include thermoplastic polyolefin elastomers, including thermoplastic polyolefin homopolymer elastomers and thermoplastic polyolefin copolymer elastomers. Examples of polyolefin homopolymers include polyethylene and polypropylene. Examples of polyolefin copolymers include polyethylene-polypropylene copolymers, as well as ethylene-vinyl acetate copolymers (EVA) and ethylene-vinyl alcohol (EVOH) copolymers.

The polymeric material may comprise from about 5 weight percent to about 100 weight percent of the polymeric component based on a total weight of the polymeric material. The polymeric component can comprise from about 15 weight percent to about 100 weight percent, from about 30 weight percent to about 100 weight percent, from about 50 weight percent to about 100 weight percent, or from about 70 weight percent to about 100 weight percent of the polymeric material. When the polymeric material comprises a non-polymeric component, the non-polymeric component may comprise from about 1 weight percent to about 20 weight percent, or from about 1 weight percent to about 10 weight percent, or from about 1 weight percent to about 5 weight percent based on a total weight of the polymeric material. As used herein, the terms "consist essentially of", "consists essentially of" and "consisting essentially of" refer to compositions which consist of less than 1 weight percent of materials other than those recited, based on a total weight of the composition. For example, "a polymeric material consisting essentially of thermoplastics" is understood to be a polymeric material which included less than 1 weight percent of non-thermoplastic polymers and non-polymeric materials; while "a polymeric material comprising a polymeric component consisting essentially of thermoplastics" is understood to include a polymeric component in which less than 1 weight percent of the polymers present are non-thermoplastic polymers, but this polymeric material may include more than 1 weight percent of non-polymeric materials.

In some aspects, the polymeric material may be a material which polymerizes or crosslinks or both polymerizes and crosslinks during the process of forming the support or during the process of forming the sole structure. The polymerization or crosslinking may be initiated by including a chemical polymerization or crosslinking initiator in the polymeric material (e.g., a chemical which initiates polymerization or crosslinking reactions within the polymeric material when it is exposed to thermal energy, UV light, or another form of actinic radiation), or the polymerization or crosslinking may be initiated by mixing together two compositions which react to produce polymerization or crosslinking reactions, or by exposing a polymeric material to a form of actinic radiation in sufficient quantity to polymerize pre-polymers or oligomers present in the exposed material, or to crosslink polymers present in the exposed polymeric material. In aspects where the material polymerizes, the polymeric material may initially comprise one or more pre-polymers or oligomers which react and polymerize during the manufacturing process, resulting in a support or sole structure comprising the reacted polymeric material. In aspects where the material crosslinks, the polymeric material may initially comprise one or more crosslinkable polymers which react with crosslinking agents or crosslinking energy and become crosslinked polymers during the manufacturing process, resulting in a support or sole structure comprising a crosslinked polymeric material. In some aspect, the resulting reacted polymeric material is a thermoset material. Similarly, in some aspects, the initial polymeric material may be a thermosetting thermoplastic material (e.g., a polymeric material comprising one or more thermoplastics and a crosslinking agent before it is thermally processed), and the resulting crosslinked polymeric material is a thermoset material (e.g., after the crosslinking agent reacts with the thermoplastics and crosslinks them, and the resulting thermoset material is solidified). One example of this is a thermosettable molten thermoplastic material comprising a thermally-activated crosslinking agent and a foaming agent, where the thermally-activated crosslinking agent is activated during a foaming process, resulting in a thermoset foam material.

Optionally, the polymeric material may comprise one or more additives. Examples of additives include fillers, polymerization initiators, crosslinking agents, UV light absorbers, anti-oxidants, processing aids such as lubricants and plasticizers, and colorants, such as pigments and dyes. Fillers may include non-polymeric fillers such as silica, clay, and titanium dioxide. Fillers may include polymeric fillers such as polymeric fibers and finely-ground polymeric powders, including ground thermoset rubber. Colorants such as naturally-occurring and synthetic pigments and dyes may be used. The polymeric material may comprise one or more additives at a concentration of from about 0.1 weight percent to about 20 weight percent, or from about 0.2 weight percent to about 10 weight percent, or from about 0.5 weight percent to about 5 weight percent, based on a total weight of the polymeric material.

The polymeric material may comprise one or more foaming agents. As understood in the art, foaming agents are substances that react, decompose or vaporize to produce quantities of gases or vapors. A chemical foaming agent is a compound which, when reacted with a second chemical or on decomposition, release a gas. Examples of chemical foaming agents include sodium bicarbonate, ammonium carbonate, ammonium bicarbonate, calcium azide, azodicarbonamide, hydrazocarbonamide, benzenesulfonyl hydrazide, dinitrosopentamethylene tetramine, toluenesulfonyl hydrazide, p,p'-oxybis(benzenesulfonylhydrazide), azobisisobutyronitrile, barium azodicarboxylate, and any combination thereof. A physical blowing agent is a compound which phase transitions from a solid, liquid or supercritical fluid to a gas when the temperature, pressure, or temperature and pressure are changed. Physical blowing agents include low-boiling-point hydrocarbons, including hydrocarbons such as isobutene and pentane, and partially halogenated hydrocarbons such as partially halogenated fluorochlorohydrocarbons, inert gasses, and supercritical fluids. In some aspects, the foaming agent is a supercritical fluid, such as supercritical carbon dioxide ($CO_2$) or supercritical nitrogen ($N_2$). The one or more foaming agents may include a chemical foaming agent and a physical foaming agent.

When a foaming agent is used, prior to the foaming step, the foaming agent may be present in the polymeric material in an amount effective to foam the polymeric material into a multicellular foam during the manufacturing process. The amount of foaming agent may be measured as the concentration of foaming agent by weight in the polymeric material prior to the foaming step. An amount of blowing agent is considered effective when the foaming process results in at least a 10 percent increase in the volume of the polymeric material, or at least a 20 percent increase in the volume of the polymeric material, or in at least a 30 percent increase in the volume of the polymeric material. The polymeric material may comprise from about 1 percent to about 30 percent by weight, or from about 1 percent to about 20 percent by weight, or from about 1 percent to about 10 percent by weight of the foaming agent based on a total weight of the polymeric material. The polymeric material may comprise a concentration of the foaming agent sufficient to expand the polymeric material by at least 100 percent by volume, or by 100 percent to 900 percent by volume, or by 200 percent to 500 percent by volume, or by 300 percent to 400 percent by volume, based on an initial volume of the polymeric material prior to foaming.

As used herein, the term "barrier sheet" (e.g., barrier sheets 152*a*, 152*b*) encompasses both monolayer and multilayer films. In some embodiments, one or both of barrier sheets the 152*a*, 152*b* are each produced (e.g., thermoformed or blow molded) from a monolayer film (a single layer). In other embodiments, one or both of the barrier sheets 152*a*, 152*b* are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier sheets 152*a*, 152*b* can independently be transparent, translucent, and/or opaque. As used herein, the term "transparent" for a barrier sheet and/or a chamber means that light passes through the barrier sheet in substantially straight lines and a viewer can see through the barrier sheet. In comparison, for an opaque barrier sheet, light does not pass through the barrier sheet and one cannot see clearly through the barrier sheet at all. A translucent barrier sheet falls between a transparent barrier sheet and an opaque barrier sheet, in that light passes through a translucent layer but some of the light is scattered so that a viewer cannot see clearly through the layer.

The barrier sheets 152*a*, 152*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier sheets 152*a*, 152*b* may include two or more sublayers (multilayer film) such as shown in Mitchell et al., U.S. Pat. No. 5,713,141 and Mitchell et al., U.S. Pat. No. 5,952,765, the disclosures of which are incorporated by reference in their entirety. In embodiments where the barrier sheets 152*a*, 152*b* include two or more sublayers, examples of suitable multilayer films include microlayer films, such as those disclosed in Bonk et al., U.S. Pat. No. 6,582,786, which is incorporated by reference in its entirety. In further embodiments, barrier sheets 152*a*, 152*b* may each independently include alternating sublayers of one or more TPU copolymer materials and one or more EVOH copolymer materials, where the total number of sublayers in each of the barrier sheets 152*a*, 152*b* includes at least four (4) sublayers, at least ten (10) sublayers, at least twenty (20) sublayers, at least forty (40) sublayers, and/or at least sixty (60) sublayers.

The chamber 154 can be produced from the barrier sheets 152*a*, 152*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier sheets 152*a*, 152*b* can be produced by coextrusion followed by vacuum thermoforming to produce an inflatable chamber 154, which can optionally include one or more valves (e.g., one way valves) that allows the chamber 154 to be filled with the fluid (e.g., gas).

The chamber 154 desirably has a low gas transmission rate to preserve its retained gas pressure. In some embodiments, the chamber 154 has a gas transmission rate for nitrogen gas that is at least about ten (10) times lower than a nitrogen gas transmission rate for a butyl rubber layer of substantially the same dimensions. In an aspect, chamber 154 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier sheets 152*a*, 152*b*). In further aspects, the transmission rate is 10 $cm^3/m^2 \cdot atm.day$ or less, 5 $cm^3/m^2 \cdot atm \cdot day$ or less, or 1 $cm^3/m^2 \cdot atm \cdot day$ or less.

Aspects

The following listing of example aspects supports and is supported by the disclosure provided herein.

A 1st aspect of the disclosure provides a sole structure for an article of footwear. The sole structure comprises a first support extending along a first axis transverse to a ground-engaging surface of the sole structure and having an outer sheath and a core, wherein the outer sheath of the first support comprises a first sheath material, and the core of the first support comprises a first core material.

In a 2nd aspect of the disclosure, the first sheath material has a higher density than the first core material.

In a 3rd aspect of the disclosure, a density of the first sheath material and the first core material are substantially the same.

In a 4th aspect of the disclosure, the first sheath material is a polymeric material including a first sheath polymeric component consisting of all polymers present in the first sheath material, and the first core material is a polymeric material including a first core polymeric component consisting of all polymers present in the first core material, optionally wherein the first sheath polymeric component and the first core polymeric component are the same.

In a 5th aspect of the disclosure, the first sheath material and the first core material are thermoplastic materials.

In a 6th aspect of the disclosure the first core material is a polymeric foam, optionally a physically-foamed polymeric foam or a chemically-foamed polymeric foam.

In a 7th aspect of the disclosure, the first support is an injection-molded support.

In an 8th aspect of the disclosure, the first core material is an injection molded polymeric foam.

In a 9th aspect of the disclosure, the first sheath material and the first core material are the same injection molded polymeric material, the outer sheath is an external skin formed in contact with a mold surface in an injection molding process, and the first sheath material is unfoamed or is a foam having a higher density than the injection molded polymeric foam of the first core material.

In a 10th aspect of the disclosure, the first sheath material is a thermoplastic material, optionally a thermoplastic elastomeric material.

In a 11th aspect of the disclosure, the first sheath material comprises a polymer chosen from a polyurethane, a polyester, a polyamide, a polystyrene, a polyolefin, and any combination thereof.

In a 12th aspect of the disclosure, the first sheath material comprises a thermoplastic elastomeric polyurethane, optionally a thermoplastic elastomeric polyester-polyurethane.

In a 13th aspect of the disclosure, the first sheath material comprises a thermoplastic elastomeric polyester copolymer, optionally a thermoplastic elastomeric polyetherester copolymer.

In a 14th aspect of the disclosure, the first sheath material comprises a thermoplastic elastomeric polyamide copolymer, optionally a thermoplastic elastomeric polyamide block copolymer.

In a 15th aspect of the disclosure, the first sheath material comprises a thermoplastic elastomeric polystyrene copolymer, optionally a thermoplastic elastomeric styrene-ethylene-butadiene-styrene (SEBS) copolymer.

In a 16th aspect of the disclosure, the first sheath material comprises a thermoplastic elastomeric polyolefin homopolymer or copolymer, optionally a thermoplastic elastomeric ethylene-propylene copolymer or a thermoplastic elastomeric ethylene-vinyl acetate (EVA) copolymer.

In a 17th aspect of the disclosure, the first core material is a thermoplastic material, optionally a thermoplastic elastomeric material.

In an 18th aspect of the disclosure, the first core material comprises a polymer chosen from a polyurethane, a polyester, a polyamide, a polystyrene, a polyolefin, and any combination thereof.

In a 19th aspect of the disclosure, the first core material comprises a thermoplastic elastomeric polyurethane, optionally a thermoplastic elastomeric polyester-polyurethane.

In a 20th aspect of the disclosure, the first core material comprises a thermoplastic elastomeric polyester copolymer, optionally a thermoplastic elastomeric polyetherester copolymer.

In a 21st aspect of the disclosure, the first core material comprises a thermoplastic elastomeric polyamide copolymer, optionally a thermoplastic elastomeric polyamide block copolymer.

In a 22nd aspect of the disclosure, the first core material comprises a thermoplastic elastomeric polystyrene copolymer, optionally a thermoplastic elastomeric styrene-ethylene-butadiene-styrene (SEBS) copolymer.

In a 23rd aspect of the disclosure, the first core material comprises a thermoplastic elastomeric polyolefin homopolymer or copolymer, optionally a thermoplastic elastomeric ethylene-propylene copolymer or a thermoplastic elastomeric ethylene-vinyl acetate (EVA) copolymer.

In a 24th aspect of the disclosure, the outer sheath completely surrounds the core.

In a 25th aspect of the disclosure, the sole structure includes a second support extending along a second axis transverse to the ground-engaging surface of the sole structure and having a second outer sheath and a second core, wherein the second outer sheath of the second support comprises a second sheath material, and the second core of the second support comprises a second core material.

In a 26th aspect of the disclosure, the second outer sheath of the second support has a higher density than the second core of the second support.

In a 27th aspect of the disclosure, the second axis is convergent with the first axis.

In a 28th aspect of the disclosure, a first distal end of the first support is connected to a second distal end of the second support.

In a 29th aspect of the disclosure, at least one of the first support and the second support are elongate.

In a 30th aspect of the disclosure, the first support is elongate.

In a 31st aspect of the disclosure, the sole structure further includes a filler material disposed on at least the first outer sheath of the first support.

In a 32nd aspect of the disclosure, the filler material is a polymeric material, optionally a thermoplastic material, optionally a thermoplastic elastomeric material.

In a 33rd aspect of the disclosure, the filler material comprises a polymer chosen from a polyurethane, a polyester, a polyamide, a polystyrene, a polyolefin, and any combination thereof.

In a 34th aspect of the disclosure, the filler material comprises a thermoplastic elastomeric polyurethane, optionally a thermoplastic elastomeric polyester-polyurethane.

In a 35th aspect of the disclosure, the filler material comprises a thermoplastic elastomeric polyester copolymer, optionally a thermoplastic elastomeric polyetherester copolymer.

In a 36th aspect of the disclosure, the filler material comprises a thermoplastic elastomeric polyamide copolymer, optionally a thermoplastic elastomeric polyamide block copolymer.

In a 37$^{th}$ aspect of the disclosure, the filler material comprises a thermoplastic elastomeric polystyrene copolymer, optionally a thermoplastic elastomeric styrene-ethylene-butadiene-styrene (SEBS) copolymer.

In a 38$^{th}$ aspect of the disclosure, the filler material comprises a thermoplastic elastomeric polyolefin homopolymer or copolymer, optionally a thermoplastic elastomeric ethylene-propylene copolymer or a thermoplastic elastomeric ethylene-vinyl acetate (EVA) copolymer.

In a 39$^{th}$ aspect of the disclosure, the sole structure further comprises a second support extending along a second axis transverse to the ground-engaging surface of the sole structure and having a second outer sheath and a second core, and wherein the filler material is disposed between the first support and the second support.

In a 40$^{th}$ aspect of the disclosure, the sole structure further comprises a third support extending along a third axis transverse to the ground-engaging surface of the sole structure and having a third outer sheath and a second core, and wherein the filler material is disposed between the second support and the third support.

In a 41$^{st}$ aspect of the disclosure, the filler material is disposed between the first support and the third support.

In a 42$^{nd}$ aspect of the disclosure, the filler material defines a cushioning component including an upper support surface of the sole structure.

In a 43$^{rd}$ aspect of the disclosure, the cushioning component defines the ground-engaging surface of the sole structure formed on an opposite side from the support surface.

In a 44$^{th}$ aspect of the disclosure, the sole structure further comprises an outsole attached to the first support at the ground-engaging surface.

A 45$^{th}$ aspect of the disclosure, an article of footwear incorporates a sole structure of the previous aspects.

A 46$^{th}$ aspect of the disclosure provides a sole structure for an article of footwear, the sole structure comprising: a first support extending along a first axis transverse to a ground-engaging surface of the sole structure and having a first outer sheath including a first sheath material and a first core including a first core material; and a second support extending along a second axis transverse to the ground-engaging surface of the sole structure and having a second outer sheath including a second sheath material and a second core including a second core material.

In a 47$^{th}$ aspect of the disclosure, the first core is a first foam core, and first sheath material has a higher density than the first core material.

In a 48$^{th}$ aspect of the disclosure, the second core is a second foam core, and second sheath material has a higher density than the second core material.

In a 49$^{th}$ aspect of the disclosure, a density of the first sheath material and the first core material are substantially the same.

In a 50$^{th}$ aspect of the disclosure, a density of the second sheath material and the second core material are substantially the same.

In a 51$^{st}$ aspect of the disclosure, the first sheath material is a polymeric material including a first sheath polymeric component consisting of all polymers present in the first sheath material, and the first core material is a polymeric material including a first core polymeric component consisting of all polymers present in the first core material, optionally wherein the first sheath polymeric component and the first core polymeric component are the same.

In a 52$^{nd}$ aspect of the disclosure, the second sheath material is a polymeric material including a second sheath polymeric component consisting of all polymers present in the second sheath material, and the second core material is a polymeric material including a second core polymeric component consisting of all polymers present in the second core material, optionally wherein the second sheath polymeric component and the second core polymeric component are the same.

In a 53$^{rd}$ aspect of the disclosure, the first outer sheath completely surrounds the first core and the second outer sheath completely surrounds the second core.

In a 54$^{th}$ aspect of the disclosure, the first outer sheath has a higher density than the first core and the second outer sheath has a higher rigidity than the second core.

In a 55$^{th}$ aspect of the disclosure, the first axis and the second axis are convergent.

In a 56$^{th}$ aspect of the disclosure, the first support and the second support intersect one another.

In a 57$^{th}$ aspect of the disclosure, a first distal end of the first support is connected to a second distal end of the second support.

In a 58$^{th}$ aspect of the disclosure, at least one of the first support and the second support are elongate.

In a 59$^{th}$ aspect of the disclosure, the sole structure further comprises a third support extending along a third axis transverse to the ground-engaging surface of the sole structure and having a third outer sheath and a third foam core, the third support attached to the first support and the second support to form a pyramid.

In a 60$^{th}$ aspect of the disclosure, the first outer sheath and the first core comprise the same material and the second outer sheath and the second core comprise the same material.

In a 61$^{st}$ aspect of the disclosure, the first outer sheath completely surrounds the first core and the second outer sheath completely surrounds the second core.

In a 62$^{nd}$ aspect of the disclosure, the first outer sheath has a higher density than the first core and the second outer sheath has a higher density than the second core.

In a 63$^{rd}$ aspect of the disclosure, the first axis and the second axis are convergent.

In a 64$^{th}$ aspect of the disclosure, the first support and the second support intersect one another.

In a 65$^{th}$ aspect of the disclosure, a first distal end of the first support is connected to a second distal end of the second support.

In a 66$^{th}$ aspect of the disclosure, at least one of the first support and the second support are elongate.

A 67$^{th}$ aspect of the disclosure provides article of footwear incorporating the sole structure of the preceding aspects.

A 68$^{th}$ aspect of the disclosure provides a sole structure for an article of footwear, the sole structure comprising: a first support extending along a first axis from a first upper distal end at a support surface of the sole structure to a first lower distal end at a ground-engaging surface of the sole structure; and a second support extending along a second axis from a second upper distal end at the support surface of the sole structure to a second lower distal end at the ground-engaging surface of the sole structure.

In a 69$^{th}$ aspect of the disclosure, the first upper distal end of the first support is connected to the second upper distal end of the second support.

In a 70$^{th}$ aspect of the disclosure, the first upper distal end of the first support and the second upper distal end of the second support are both connected to a first node disposed at the support surface of the sole structure.

In a 71st aspect of the disclosure, the first lower distal end of the first support is connected to the second lower distal end of the second support at the ground-engaging surface of the sole structure.

In a 72nd aspect of the disclosure, the first support has a first thickness measured across the first axis and the second support has a second thickness measured across the second axis.

In a 73rd aspect of the disclosure, the first thickness is the same as the second thickness.

In a 74th aspect of the disclosure, the first thickness is different from the second thickness, optionally wherein the first thickness differs from the second thickness by 5 percent or more.

In a 75th aspect of the disclosure, the first axis of the first support extends at an oblique angle relative to at least one of the ground-engaging surface or the support surface.

A 76th aspect of the disclosure further comprises a bladder defining a chamber, wherein the first support and the second support are disposed within the chamber.

In a 77th aspect of the disclosure, the bladder includes (i) an upper barrier layer attached to the first upper distal end of the first support and the second upper distal end of the second support and (ii) a lower barrier layer attached to the first lower distal end of the first support and the second lower distal end of the second support.

In a 78th aspect of the disclosure, the first support includes a first outer sheath comprising a first sheath material and a first inner core comprising a first core material, and wherein the second support includes a second outer sheath comprising a second sheath material and a second inner core comprising a second core material.

In a 79th aspect of the disclosure, the first core material is a first foam material, and first sheath material has a higher density than the first core material.

In an 80th aspect of the disclosure, the second core is a second foam core, and second sheath material has a higher density than the second core material.

In an 81st aspect of the disclosure, a density of the first sheath material and the first core material are substantially the same.

In an 82nd aspect of the disclosure, a density of the second sheath material and the second core material are substantially the same.

In an 83rd aspect of the disclosure, the first sheath material is a polymeric material including a first sheath polymeric component consisting of all polymers present in the first sheath material, and the first core material is a polymeric material including a first core polymeric component consisting of all polymers present in the first core material, optionally wherein the first sheath polymeric component and the first core polymeric component are the same.

In an 84th aspect of the disclosure, the second sheath material is a polymeric material including a second sheath polymeric component consisting of all polymers present in the second sheath material, and the second core material is a polymeric material including a second core polymeric component consisting of all polymers present in the second core material, optionally wherein the second sheath polymeric component and the second core polymeric component are the same.

An 85th aspect of the disclosure further comprises a foam cushioning element adjacent to each of the first upper distal end and the second upper distal end and defining the support surface of the sole structure, wherein the foam cushioning element comprises a foam cushioning element material, the foam cushioning element material comprising a polymeric component consisting of all the polymers present in the foam cushioning element material, optionally wherein the polymeric component of the foam cushioning element material is different from the first sheath polymeric component of the first sheath material, or is different from the second sheath polymeric component of the second sheath material, or is different from both the first sheath material and the second sheath material.

An 86th aspect of the disclosure provides a method of forming a sole structure, the method comprising: extending a first support along a first axis transverse to a ground-engaging surface of the sole structure and having an outer sheath including a first sheath material and a foam core including a first core material, the outer sheath having a higher density than the foam core.

In an 87th aspect of the disclosure, the method further comprises forming the outer sheath and the foam core from the same material.

In an 88th aspect of the disclosure, the method further comprises completely surrounding the foam core with the outer sheath.

In an 89th aspect of the disclosure, the method further comprises extending a second support along a second axis transverse to the ground-engaging surface of the sole structure and having an outer sheath and a foam core.

In a 90th aspect of the disclosure, the method further comprises providing the second support with an outer sheath having a higher rigidity than the foam core of the second support.

In a 91st aspect of the disclosure, extending the second support along a second axis includes extending the second support along a second axis that is convergent with the first axis.

In a 92nd aspect of the disclosure, the method further comprises connecting a first distal end of the first support to a second distal end of the second support.

In a 93rd aspect of the disclosure, the method further comprises providing the first support with a length that is greater than its width and providing the second support with a length that is greater than its width.

In a 94th aspect of the disclosure, the method further comprises providing the first support with a length that is greater than its width.

In a 95th aspect of the disclosure, the first sheath material and the first core material are both polymeric materials, and the method further comprises injection molding the first sheath polymeric material and the first core polymeric material to form the first support.

In a 96th aspect of the disclosure, the injection molding process includes foaming the first core polymeric material, optionally wherein the foaming comprises physically-foaming the first core polymeric material or chemically-foaming the first core polymeric material.

In a 97th aspect of the disclosure, the foaming comprises physically-foaming the first core polymeric material using a physical foaming agent, and the physical foaming agent comprises or consists essentially of a supercritical fluid chosen from supercritical carbon dioxide (CO2) and supercritical nitrogen ($N_2$).

In a 98th aspect of the disclosure, the first sheath material and the first core material are the same polymeric material and the injection molding process comprises: melting the polymeric material to form molten polymeric material; mixing the molten polymeric material and a supercritical fluid to form a single-phase solution of the supercritical fluid dissolved in the molten polymeric material; injecting the single-phase solution into a mold cavity configured to form the first support; decreasing pressure within the mold cavity to initiate formation and expansion of gas bubbles within the molten polymeric material as the supercritical fluid phase transitions to a gas, thereby physically foaming the polymeric material; and solidifying the physically-foamed polymeric material in the mold cavity, thereby forming the first support, wherein, following the solidification, the first outer sheath comprises the polymeric material in the form of a solidified skin surrounding the foam core, and the foam core comprises solidified physically-foamed polymeric material; optionally, wherein the method further comprises removing the first support from the mold cavity.

In a 99$^{th}$ aspect of the disclosure, the solidified skin and the solidified physically-foamed polymeric material are thermoplastic.

In a 100$^{th}$ aspect of the disclosure, the method further comprises disposing a filler material onto the first outer sheath, optionally wherein the filler material is a polymeric filler material.

In a 101$^{st}$ aspect of the disclosure, the disposing comprises injecting a filler material onto the outer sheath.

In a 102$^{nd}$ aspect of the disclosure, the disposing further comprises foaming the disposed filler material, wherein the foaming comprises physically foaming the disposed filler material or chemically foaming the disposed filler material.

In a 103$^{rd}$ aspect of the disclosure, the disposing comprises injecting a single-phase solution of a molten filler polymeric material and a supercritical fluid physical foaming agent onto the first outer sheath of the first support while within a mold cavity configured to form a composite structure including the first support, decreasing a pressure within the mold cavity, decreasing pressure within the mold cavity to initiate formation and expansion of gas bubbles within the molten filler polymeric material as the supercritical fluid phase transitions to a gas, thereby physically foaming the filler polymeric material; solidifying the foamed filler polymeric material in the mold cavity, thereby forming the composite structure including the first support, wherein, following the solidification, the composite structure includes the first support surrounded by the solidified physically-foamed filler polymeric material; and removing the solidified composite structure from the mold cavity.

In a 104$^{th}$ aspect of the disclosure, the method comprising incorporating the sole structure of the 1$^{st}$ Aspect into the article of footwear.

In a 105$^{th}$ aspect of the disclosure, the method comprises: extending a first support along a first axis transverse to a ground-engaging surface of the sole structure and having a first outer sheath and a first core; and extending a second support along a second axis transverse to the ground-engaging surface of the sole structure and having a second outer sheath and a second core.

In a 106$^{th}$ aspect of the disclosure, the first core is a first foam core, or the second core is a second foam core, or both the first core is a first foam core and the second core is a second foam core.

In a 107$^{th}$ aspect of the disclosure, the method comprises forming the first outer sheath and the first foam core from the same material and forming the second outer sheath and the second foam core from the same material.

In a 108$^{th}$ aspect of the disclosure, the method comprises completely surrounding the first foam core with the first outer sheath and completely surrounding the second foam core with the second outer sheath.

In a 109$^{th}$ aspect of the disclosure, the method comprises providing the first outer sheath with a higher density than the first foam core and providing the second outer sheath with a higher density than the second foam core.

In a 110$^{th}$ aspect of the disclosure, extending the second support along a second axis includes extending the second support along a second axis that is convergent with the first axis.

In a 111$^{st}$ aspect of the disclosure, the method comprises intersecting the first support and the second support.

In a 112$^{nd}$ aspect of the disclosure, the method comprises connecting a first distal end of the first support to a second distal end of the second support at a joint.

In a 113$^{rd}$ aspect of the disclosure, the method comprises providing the first support with a length that is greater than its width and providing the second support with a length that is greater than its width.

In a 114$^{th}$ aspect of the disclosure, the method comprises extending a third support along a third axis transverse to the ground-engaging surface of the sole structure and having a third outer sheath and a third foam core, the third support attached to the first support and the second support to form a pyramid.

In a 115$^{th}$ aspect of the disclosure, the method comprises forming at least one of the first support and the second support via a physical foaming process, optionally via a MUCELL physical foaming process.

A 116$^{th}$ aspect of the disclosure includes incorporating sole structure of the 105$^{th}$ aspect into an article of footwear.

A 117$^{th}$ aspect of the disclosure includes a sole structure for an article of footwear, the sole structure comprising: a first support extending along a first axis transverse to a ground-engaging surface of the sole structure, the first support being formed via a physical foaming process, optionally via a MUCELL physical foaming process.

In a 118$^{th}$. The sole structure of claim 117th, wherein the first support includes a first core and a first outer sheath formed by the MUCELL physical foaming process.

In a 119$^{th}$ aspect of the disclosure, the first outer sheath and the first core are formed from the same material.

In a 120$^{th}$ aspect of the disclosure, the first outer sheath has a higher density than the first core.

In a 121$^{st}$ aspect of the disclosure, the sole structure further comprises a second support extending along a second axis transverse to a ground-engaging surface of the sole structure, the second support being formed via the physical foaming process, optionally via the MUCELL physical foaming process.

In a 122$^{nd}$ aspect of the disclosure, the second support includes a second core and a second outer sheath formed by the MUCELL physical foaming process.

In a 123$^{rd}$ aspect of the disclosure, the second outer sheath and the second core are formed from the same material.

In a 124$^{th}$ aspect of the disclosure, the second outer sheath has a higher density than the second core.

A 125$^{th}$ aspect of the disclosure provides an article of footwear incorporating the sole structure of any of the 117th-124$^{th}$ aspects.

A 126$^{th}$ aspect of the disclosure incorporates the sole structure of any of the 117$^{th}$-124$^{th}$ aspects into an article of footwear.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

What is claimed is:

1. A sole structure for an article of footwear, the sole structure comprising:

a first support comprising:

a base;

a platform spaced apart from the base;

a first strut comprising a first polymeric material, extending along a first axis passing through a ground-engaging surface of the sole structure, and including a first end attached to the base and a second end spaced from the first end with respect to the first axis and attached to the platform;

a second strut comprising a second polymeric material, extending along a second axis convergent with the first axis and passing through the ground-engaging surface of the sole structure, and including a first end attached to the base and a second end spaced from the first end of the second strut with respect to the second axis and attached to the platform, the second strut being spaced apart from the first strut with respect to a longitudinal axis of the sole structure; and a first void defined by and extending between the first strut and the second strut;

a second void at least partially surrounding an exterior of the first support; and a cushion contained within the first void and spaced apart from the second void, wherein the first strut and the second strut each comprises a core and a sheath surrounding the core, the sheath having a greater density than the core.

2. The sole structure of claim 1, wherein the cushion comprises foam.

3. A sole structure for an article of footwear, the sole structure comprising:

a first support comprising:

a base;

a platform spaced apart from the base;

a first strut comprising a first polymeric material, extending along a first axis passing through a ground-engaging surface of the sole structure, and including a first end attached to the base and a second end spaced from the first end with respect to the first axis and attached to the platform; and a second strut comprising a second polymeric material, extending along a second axis passing through the ground-engaging surface of the sole structure, and including a first end attached to the base and a second end spaced from the first end of the second strut with respect to the second axis and attached to the platform, the first strut and the second strut cooperating to define a first void between the first strut and the second strut and being spaced apart from each other with respect to a longitudinal axis of the sole structure;

a second void at least partially surrounding an exterior of the first support; and a cushion substantially filling the first void and spaced apart from the second void, wherein the first strut and the second strut each comprises a core and a sheath surrounding the core.

4. The sole structure of claim 3, wherein the first axis and the second axis diverge in a direction toward the ground-engaging surface.

5. The sole structure of claim 3, wherein the cushion tapers in a direction away from the ground-engaging surface.

6. The sole structure of claim 3, wherein the cushion comprises foam.

7. The structure of claim 3, wherein the sheath includes a greater density than the core.

8. A sole structure for an article of footwear, the sole structure comprising:

a first support comprising:

a base;

a platform spaced apart from the base;

a first strut comprising a first polymeric material, extending along a first axis passing through a ground-engaging surface of the sole structure, and including a first end attached to the base and a second end spaced from the first end with respect to the first axis and attached to the platform;

a second strut comprising a second polymeric material, extending along a second axis passing through the ground-engaging surface of the sole structure, and including a first end attached to the base and a second end spaced from the first end of the second strut with respect to the second axis and attached to the platform, the first strut and the second strut being spaced from each other with respect to a longitudinal axis of the sole structure; and a first void defined between the first strut, the second strut, the base, and the platform, wherein the first strut and the second strut each comprises a core and a sheath surrounding the core;

a second void at least partially surrounding an exterior of the first support; and a cushion disposed external from the first void and including an upper surface and a lower surface opposite the upper surface, the lower surface being coupled to the platform.

9. The sole structure of claim 8, wherein the cushion comprises foam.

10. The structure of claim 8, wherein the sheath includes a greater density than the core.

11. The sole structure of claim 8, wherein the first axis and the second axis diverge in a direction toward the ground-engaging surface.

* * * * *